US005757326A

United States Patent [19]

Koyama et al.

[11] Patent Number: 5,757,326

[45] Date of Patent: May 26, 1998

[54] SLOT ANTENNA DEVICE AND WIRELESS APPARATUS EMPLOYING THE ANTENNA DEVICE

[75] Inventors: Shunsuke Koyama; Teruhiko Fujisawa; Norio Hama, all of Suwa, Japan

[73] Assignee: Seiko Epson Corporation, Tokyo, Japan

[21] Appl. No.: 786,099

[22] Filed: Jan. 17, 1997

Related U.S. Application Data

[63] Continuation of Ser. No. 583,527, Jan. 5, 1996, abandoned, which is a continuation of Ser. No. 219,165, Mar. 28, 1994, abandoned.

[30] Foreign Application Priority Data

Mar. 29, 1993 [JP] Japan ..... 5-070385
Nov. 17, 1993 [JP] Japan ..... 5-288455

[51] Int. Cl.[6] ..... H01Q 1/24

[52] U.S. Cl. ..... 343/702; 343/767

[58] Field of Search ..... 343/767, 700 MS, 343/702, 718, 846, 745; 455/89, 351; H01Q 13/08, 21/00, 1/24

[56] References Cited

U.S. PATENT DOCUMENTS

| | | | |
|---|---|---|---|
| 2,629,051 | 2/1953 | Lindenblad | 343/767 |
| 3,918,062 | 11/1975 | Haruki et al. | 343/702 |
| 4,035,807 | 7/1977 | Tang et al. | 343/742 |
| 4,713,808 | 12/1987 | Gaskill et al. | 370/94 |
| 4,775,866 | 10/1988 | Shibata et al. | 343/700 MS |
| 4,816,838 | 3/1989 | Mizuno et al. | 343/771 |
| 4,862,181 | 8/1989 | Ponce de Leon et al. | 343/702 |
| 4,862,516 | 8/1989 | Macnak et al. | 343/718 |
| 4,920,353 | 4/1990 | Mori et al. | 343/702 |
| 4,955,084 | 9/1990 | Umetsu et al. | 343/702 |
| 4,975,711 | 12/1990 | Lee | 343/702 |
| 4,980,694 | 12/1990 | Hines | 343/702 |

(List continued on next page.)

FOREIGN PATENT DOCUMENTS

| | | |
|---|---|---|
| 0 122 485 | 10/1984 | European Pat. Off. . |
| 0 372 430 | 6/1990 | European Pat. Off. . |
| 0 538 485 | 4/1993 | European Pat. Off. . |
| 0 538 485 A1 | 4/1993 | European Pat. Off. . |
| 0 565 725 A1 | 10/1993 | European Pat. Off. . |
| 31-5906 | 6/1954 | Japan . |
| 55-12762 | 4/1980 | Japan . |
| 56-27514 | 3/1981 | Japan . |

(List continued on next page.)

OTHER PUBLICATIONS

Hall, P.S. et al., "Survey of Design Techniques for Flat Profile Microwave Antennas and Arrays." *The Radio and Electronic Engineer*, vol. 48, No. 11, pp. 549–565, Nov. 1978.

Hideo Ito et al., "A Small–Loop Antenna for Pocket–Size VHF Radio Equipment," *National Technical Report*, vol. 19 No. 2, Apr. 1973.

K. Fujimoto et al., "Small Antennas," *Research Studies Press Ltd.*

Teruhiko Fujisawa et al., "A Study on Small Slot Antenna for Wrist Watch Type Portable Radio Equipment," Technical Report of IEICE.

*Primary Examiner*—Michael C. Wimer
*Attorney, Agent, or Firm*—Oliff & Berridge, PLC

[57] ABSTRACT

A miniaturized and thin slot antenna device maintains high transmitting and receiving performance by improving the configuration of an antenna body and a circuit substrate. The slot antenna device includes an antenna body made of an electrically conductive member having a slot into which the circuit substrate is placed. Alternatively, the slotted, electrically conductive member can be placed flat on a first surface of the circuit substrate, which can contain a reflector on its second, opposite surface. The slot antenna device also can be constructed from two parallel, opposed, electrically conductive members spaced apart by a gap so that a slot is defined by outer peripheries of the electrically conductive members. The electrically conductive members can be provided on opposite surfaces of a circuit substrate.

35 Claims, 28 Drawing Sheets

U.S. PATENT DOCUMENTS

| | | | |
|---|---|---|---|
| 5,001,778 | 3/1991 | Ushiyama et al. | 343/702 |
| 5,007,105 | 4/1991 | Kudoh et al. | 343/718 |
| 5,048,118 | 9/1991 | Brooks et al. | 343/702 |
| 5,079,559 | 1/1992 | Umetsu et al. | 343/702 |
| 5,113,196 | 5/1992 | Ponce de Leon et al. | 343/744 |
| 5,134,418 | 7/1992 | Gomez et al. | 343/718 |
| 5,179,733 | 1/1993 | Matsui | 455/344 |
| 5,227,804 | 7/1993 | Oda | 343/702 |
| 5,231,407 | 7/1993 | McGirr et al. | 343/702 |
| 5,365,244 | 11/1994 | Yon et al. | 343/767 |
| 5,467,095 | 11/1995 | Rodal et al. | 343/700 MS |

FOREIGN PATENT DOCUMENTS

| | | |
|---|---|---|
| 56-169401 | 12/1981 | Japan . |
| 58-94204 | 6/1983 | Japan . |
| 59-44103 | 3/1984 | Japan . |
| 61-200702 | 9/1986 | Japan . |
| 61-50542 | 11/1986 | Japan . |
| 62-24705 | 2/1987 | Japan . |
| 63-163185 | 7/1988 | Japan . |
| 3-88404 | 4/1991 | Japan . |
| 3-181208 | 8/1991 | Japan . |
| 4-211522 | 8/1992 | Japan . |
| 2 165 396 | 4/1986 | United Kingdom . |
| 2 201 266 A | 8/1988 | United Kingdom . |
| 2 216 726 | 10/1989 | United Kingdom . |
| 2 217 112 A | 10/1989 | United Kingdom . |
| 2 229 319 | 9/1990 | United Kingdom . |
| 2 240 219 | 7/1991 | United Kingdom . |
| 2 248 522 | 4/1992 | United Kingdom . |
| 2 251 520 | 7/1992 | United Kingdom . |
| WO 91/02386 | 2/1991 | WIPO . |
| WO 94/08361 | 4/1994 | WIPO . |

SLOT ANTENNA DEVICE AND WIRELESS APPARATUS EMPLOYING THE ANTENNA DEVICE

This is a continuation of application Ser. No. 08/583,527 filed Jan. 5, 1996, now abandoned which is a continuation of Ser. No. 08/219,165 filed Mar. 28, 1994, now abandoned.

BACKGROUND OF THE INVENTION

1. Field of the Invention

The present invention relates to an antenna device for use with a portable wireless apparatus such as, for example, a pager. More particularly, the present invention pertains to a slot antenna device of the type that can be housed in a case and also to a wireless apparatus employing the antenna device.

2. Description of Related Art

Conventionally, portable wireless apparatus such as portable telephones have employed a monopole antenna, an inverted F type antenna and so on, while devices such as pagers have employed a ferrite antenna, a small-loop antenna, a plate type loop antenna and so on. The radiation efficiency or reception efficiency of an antenna, however, is determined by the ratio of the wavelength of electric radiation employed and the size of the antenna. Accordingly, a small antenna, as can be employed in a pager, must be used at a high frequency, and therefore it is impossible to realize a pager that can be used in the FM band and so on. Since a loop antenna, for instance, requires a large aperture in order to be usable in the FM band, it cannot be employed in a pager.

SUMMARY OF THE INVENTION

Taking the above-mentioned problems into consideration, an object of the invention is to provide a slot antenna device that is suitable for being housed in a small, thin case while maintaining high transmission and reception performance, and a wireless apparatus employing this antenna device, by improving the configuration of the antenna body and the circuit substrate placed in the wireless apparatus together with the antenna.

In order to achieve the above and other objects, according to the invention, there is provided a slot antenna device suitable for being housed in a case. According to a first aspect of the invention, the slot antenna device has a slot antenna body comprised of an electrically conductive plate formed with a slot therein, and a circuit substrate (e.g., a circuit board) in which a wireless apparatus circuit capable of performing transmitting and/or receiving through the slot antenna body is formed, wherein the circuit substrate is inserted in the slot. Because the antenna body according to the invention is a slot antenna, it is sensitive to magnetic components. Accordingly, since this antenna can be expected to have improved sensitivity when fitted on a human body, it is appropriate for use as a portable antenna device, for example, in a pager. Since the circuit board is inserted in the slot, the wavelength of received signals can be shortened, in much the same way as occurs when a dielectric material is filled in the slot of a slot antenna. Therefore, even a small-sized antenna body can receive electromagnetic waves having relatively long wavelength (i.e., low frequency).

It is preferred that the slot have an aperture that faces in two-directions or in four-directions. This is achieved by forming a bend in an electrically conductive plate in which the slot is formed. The conductive plate (or member) is bent in a direction so that the bend line intersects (e.g., is perpendicular to) the slot. For example, one bend can be formed in the plate to form an L-shape so that the slot faces in two directions. Alternatively, two bends are formed in the electrically conductive plate to form a U-shape so that the slot faces in three directions. As a third alternative, four bends are formed in the electrically conductive plate so that the electrically conductive plate is rectangular shaped with the slot facing in four directions.

According to another aspect of the invention, the overall size of the antenna device is thinned by placing the electrically conductive plate (having a slot) opposite to (e.g., parallel to and opposed to) a surface of the circuit board containing the wireless apparatus circuit.

Additionally, two bends can be formed in the electrically conductive plate so that the electrically conductive plate has two leg portions and a connecting portion, with the slot facing in three directions. One leg portion is located on a top surface of the circuit board, the other leg portion is located adjacent to the circuit board bottom surface, and the connecting portion is located along the outer peripheral side of the circuit board. Additionally, bends can be provided near the ends of both leg portions so that the ends bend toward and are attached to the top and bottom circuit board surfaces, respectively.

According to another aspect of the invention, the electrically conductive member formed with a slot can be attached to a first surface of a circuit board and a reflective plate (reflector) can be provided on an opposite surface of the circuit board.

The electrically conductive member and the reflector can be formed by bending one electrically conductive plate along its length at two bend locations. A dielectric material also can be filled between the slot-containing portion of the electrically conductive member and the reflector, and also in the slot.

According to another aspect of the invention, in order to decrease the number of parts, facilitating miniaturization, the electrically conductive member can be a conductor pattern formed on the circuit board instead of a separate metal plate that must be attached to the circuit board.

When a reflector is provided, it is preferred that the reflector be larger in area than the slot-containing portion of the electrically conductive member. This is facilitated easily by forming the reflector from a conductor pattern formed on the bottom surface of the circuit board. When a circuit board is a multi-layer substrate with a plurality of electrically conductive layers, it is possible to form the electrically conductive member and the reflector from conductor patterns formed on two of the electrically conductive layers.

According to another aspect of the invention, a slot antenna is formed from a pair of electrically conductive members opposed and spaced from each other so as to define a gap between them. The gap between the electrically conductive members defines a slot that extends around the outer peripheral sides of the electrically conductive members. A short circuit portion (a connecting portion) is formed between the electrically conductive members to electrically connect the electrically conductive members to each other at a predetermined position along their outer peripheral sides. This forms a thin antenna body. Because the slot opens outward (i.e., the slot extends in all directions of the plane containing the electrically conductive members), the antenna body has an improved directivity. It is preferred to provide approximately in the center in the lengthwise direction of the slot, a tuning capacitance element for electrically connecting with both electrically conductive members. The tuning capacitance element can be, for example, a chip capacitor or a tuning varactor diode. It is also preferred that at least one of the electrically conductive members have an outer periphery bent toward the other electrically conductive member.

A circuit block containing a wireless apparatus circuit can be placed between the electrically conductive members to provide a compact structure. In order to prevent excessive noise, an aperture preferably is formed in each conductive member at a location opposed to an area where the wireless apparatus circuit is located.

Alternatively, it is possible to form an aperture in a location opposed to an area where the wireless apparatus circuit is located in only one of the electrically conductive members. A display panel can be provided on the top side of the wireless apparatus circuit, and can be viewed through the aperture so that it is possible to watch the information displayed on the display panel without being obstructed by the electrically conductive member. With this structure, the electrically conductive member on the side on which the aperture is formed constitutes a case main body and defines one surface of the antenna device, while the electrically conductive member on the other side (which does not include an aperture) constitutes a cover member that covers the back of the case main body. A spacer is placed between the conductive members to maintain the slot by insulating the case main body from the cover material.

In accordance with another aspect of the invention, in order to provide an even thinner structure, the pair of electrically conductive members which are opposed to each other and separated by a gap so as to define a slot between their outer peripheries, the electrically conductive members are formed on oppositely facing surfaces, respectively, of a circuit substrate such as a circuit board that contains a wireless apparatus circuit. The thickness of the circuit board defines the slot width. A tuning capacitance element such as a chip capacitor or a tuning varactor diode, for electrically connecting with both electrically conductive members can be formed on the circuit board at about the center of the slot length as measured from the connecting portion. A through-hole in the circuit board can be provided to electrically connect the tuning capacitance element to both electrically conductive members.

At least one of the electrically conductive members can be formed of an electrically conductive pattern formed on the circuit board in which the wireless apparatus circuit is formed.

Alternatively, at least one of the electrically conductive members can be fixed to a conductive pattern formed on the circuit board. The electrically conductive member can be an electrically conductive wire. The electrically conductive member also can be made of a planar electrically conductive plate. The plate can be provided with a side part bent on its outer peripheral side or with a terminal.

The electrically conductive members can be placed on an area of the circuit board adjacent to the wireless apparatus circuit.

The short circuit (connecting) portion also can be formed in a through-hole of the circuit board. Furthermore, preferably the electrically conductive members are located along the edge of the circuit board.

In such a slot antenna device, a first feed point to a terminal of a wireless apparatus circuit comprised of an unbalanced circuit, and a second feed point to a ground terminal of the wireless apparatus circuit can be provided on both sides of the slot. Alternatively, a feed point to two terminals of a wireless apparatus circuit comprised of a balanced circuit can be established on both sides of the slot.

BRIEF DESCRIPTION OF THE DRAWINGS

The invention will be described in detail with reference to the following drawings in which like reference numerals refer to like elements and wherein.

DETAILED DESCRIPTION OF PREFERRED EMBODIMENTS

Preferred embodiments according to the present invention will be explained with reference to the attached drawings. In any of the embodiments, each antenna body is formed in a case and constitutes a portable antenna device of the type housed in a case for use in such apparatus as a pager, a portable wireless telephone, a radio, a transceiver, a pocket TV, or a card-type pager, for example. Although specific embodiments that utilize circuit boards are described, other types of circuit substrates such as flexible circuit boards or ceramic substrates may be used. Additionally, the electrically conductive members can be metal plates, conductor patterns or wires, for example, as will become apparent. Further, the wireless apparatus circuits can be a transmitting circuit, a receiving circuit, or a circuit that transmits and receives.

First Embodiment

Figure 1A:
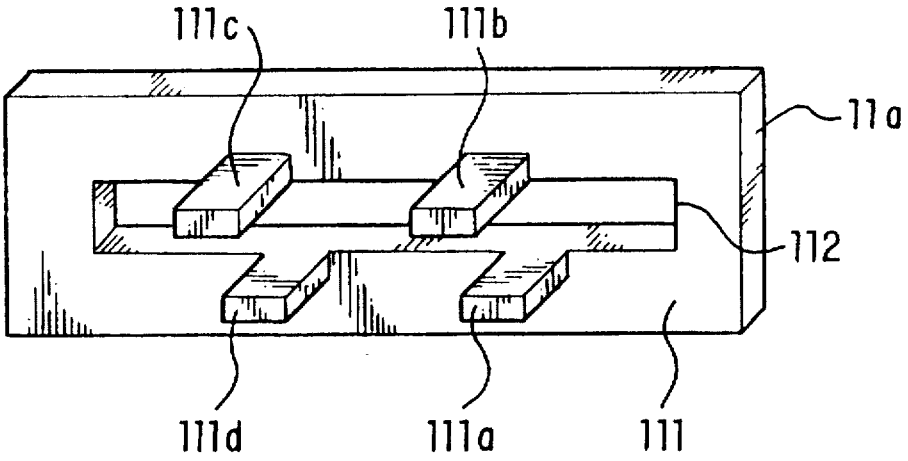
FIG. 1A schematically illustrates the structure of an antenna body in an antenna device according to a first embodiment of the present invention.
Figure 1B:
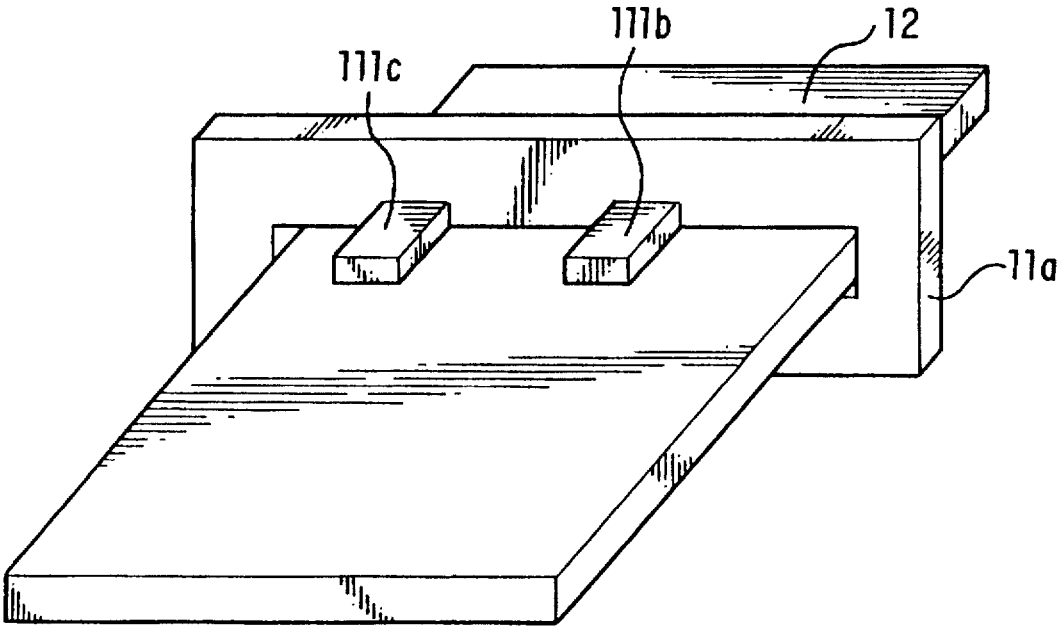
FIG. 1B illustrates the configuration of the FIG. 1A antenna body and a circuit substrate, which can be provided in a portable wireless apparatus.

FIG. 1A illustrates schematically the structure of an antenna body in an antenna device according to a first embodiment. FIG. 1B shows the configuration of the antenna body and a circuit substrate, such as, for example, a circuit board, which can be included in a portable wireless apparatus together with the antenna body.

In the first embodiment, an antenna body 11*a* of a portable wireless apparatus (slot antenna device) is comprised of a band-like electrically conductive plate member 111 that has a slot 112 formed in the lengthwise direction across the center of the band-like electrically conductive plate 111. This antenna body 11*a* functions as a slot antenna. The electrically conductive plate 111 has terminals 111*a* to 111*d* projecting perpendicular from the edge of slot aperture 112. The antenna body 11*a* with such a structure is contained in a case of a wireless apparatus together with a circuit board 12 (which can be, for example, a copper-clad glass epoxy laminate) in which is formed a wireless apparatus circuit through which transmitting and/or receiving is performed.

In this embodiment, when the antenna body 11*a* and the circuit board 12 are contained in a case of a wireless apparatus, as shown in FIG. 1B, the circuit board 12 is inserted in the slot 112 of the antenna body 11*a*. Since each of the terminals 111*a* to 111*d* is located adjacent to a surface of the circuit board 12 in this state, the antenna body 11*a* and the circuit board 12 can be held together by fixing each of the terminals 111*a* to 111*d* on a conductor pattern of the circuit board 12, by means of soldering, for example.

A wireless apparatus circuit having a tuning capacitance element, a feed circuit or a receiving circuit and so on are formed on circuit board 12. For example, the terminals 111*a* and 111*b* can be electrically connected with the tuning capacitance element, while the feed circuit or the receiving circuit can be electrically connected between the terminals 111*c* and 111*d*. If the feed circuit or the receiving circuit is an unbalanced circuit, either the terminal 111*c* or the terminal 111*d* is made to be at ground electric potential. On the other hand, if the feed circuit or the receiving circuit is a balanced circuit, the terminals 111*c* and 111*d* are each electrically connected with a balanced input terminal of the circuit. In order to realize impedance matching of the antenna body 11*a* and the wireless apparatus circuit, it is necessary to move the position of the feed point of the antenna body 11*a* from the connection position of the tuning capacitance element. Therefore, the terminals 111*a* and 111*b* and the terminals 111*c* and 111*d* are formed in relatively distant positions, and the distance is determined by the electrical characteristics of the antenna body 11*a* and the wireless apparatus circuit.

Figure 2:
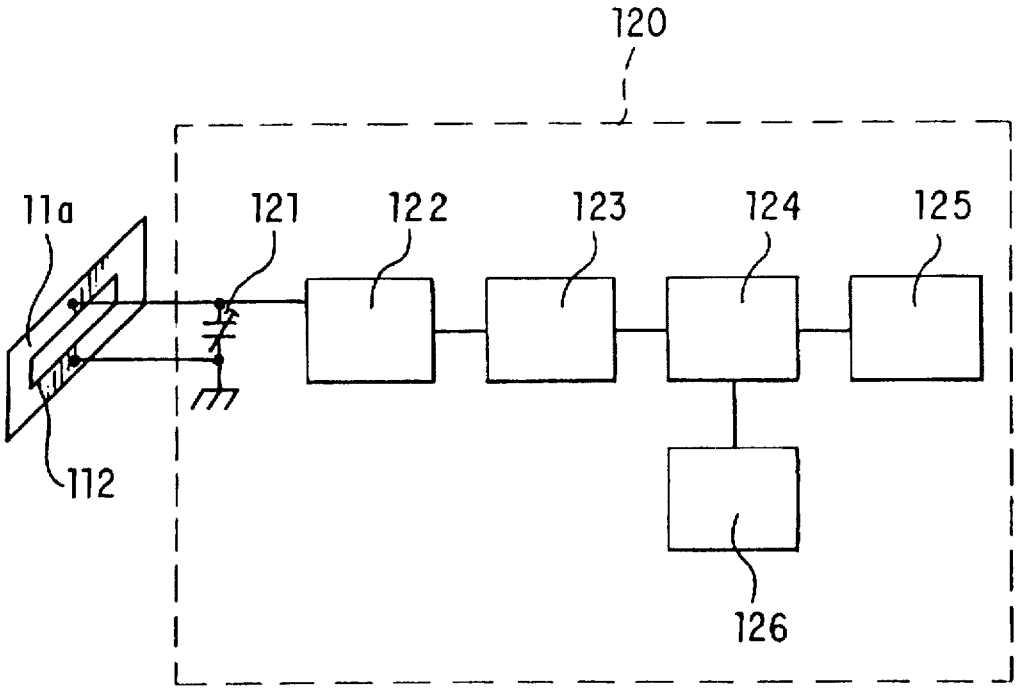
FIG. 2 is a block diagram of a super heterodyne receiver circuit in which the antenna device illustrated in FIG. 1A can be included.

If the portable wireless apparatus in which the antenna body 11*a* is used is a fixed frequency receiver, as shown in FIG. 2, for instance, a single super heterodyne circuit 120 is provided in the wireless apparatus circuit. In this circuit, the receiving frequency in the antenna body 11*a* is selected by its own electrical characteristics and those of the tuning capacitance element 121 connected with the antenna body 11*a* across the slot 112. A connection circuit 122 is formed in the next stage of the tuning capacitance element 121, and the connection circuit 122 aligns an amplification circuit 123 in the next stage and an antenna circuit comprised of the antenna body 11*a* and the tuning capacitance element 121. In the next stage of the amplification circuit 123, a frequency conversion circuit 124 is formed that converts the frequency of received signals based on signals from an oscillating circuit 126. In the next stage, a demodulating (i.e., decoder) circuit 125 is provided to demodulate (decode) the received signals the frequency of which was converted.

Figure 3:
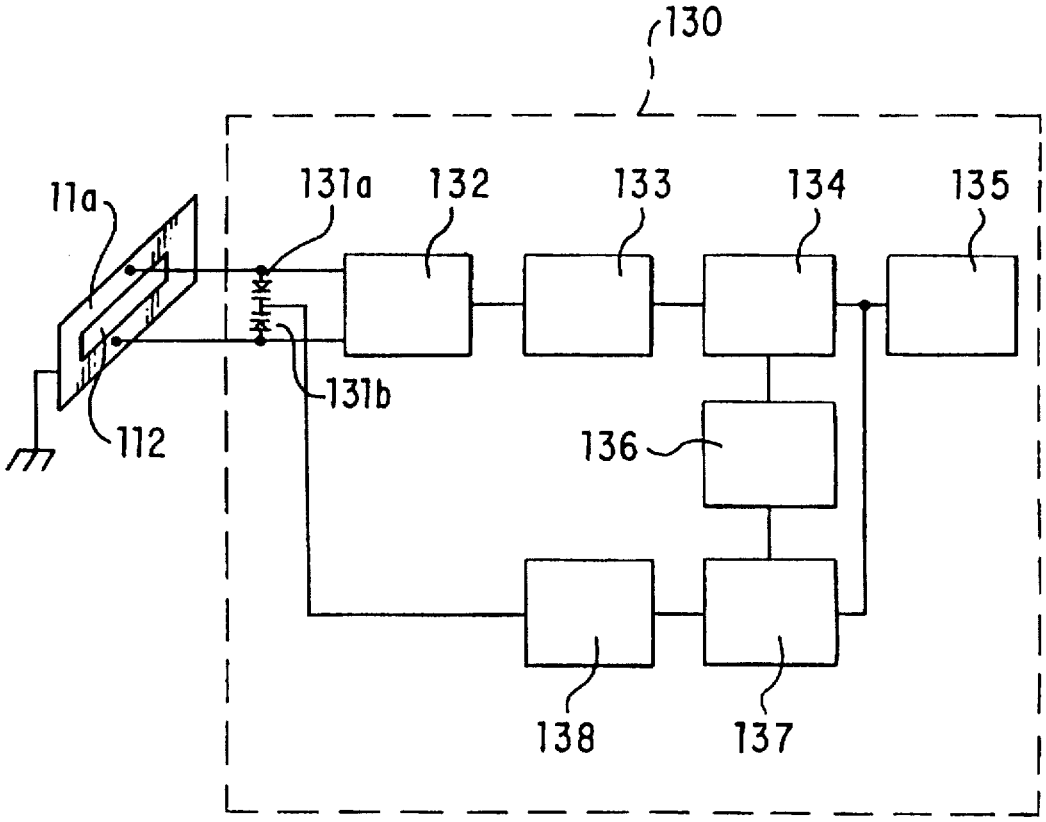
FIG. 3 is a block diagram of a wide-band receiver circuit in which the antenna device illustrated in FIG. 1A can be included.

When a wireless apparatus in which the antenna body 11*a* is used is a receiver having a wide frequency range (wide area receiver), as shown in FIG. 3, for instance, a receiving circuit with a wide frequency range (wide area receiver) 130 is formed in the wireless apparatus circuit. In this circuit, the receiving frequency of the antenna body 11*a* also is selected by its own electrical characteristics and by those of a varactor diode that functions as a tuning capacitance element 131*a*, 131*b* connected with the antenna body 11*a* across the slot 112. In the next stage of the varactor diode 131*a*, 131*b*, a connection circuit 132 and an amplification circuit 133 are provided. In the next stage of the amplification circuit 133, a frequency conversion circuit 134 to convert the frequency of received signals based on the signals from an oscillating circuit 136, and a demodulating circuit 135 to demodulate the output signals are formed. Furthermore, a level detection circuit 137 to detect a signal level after the frequency conversion, and a tuning voltage build-up circuit 138 to control the voltage applied to the tuning capacitance element 131*a*, 131*b* in such a way as to maximize the signal level based on the detection result are formed. The anode of the tuning capacitance element 131*a*, 131*b* (varacator diode) can be made to be ground electric potential without disturbing the balance by making one end of the antenna body 11 a ground (earth) electric potential.

Figure 4A:
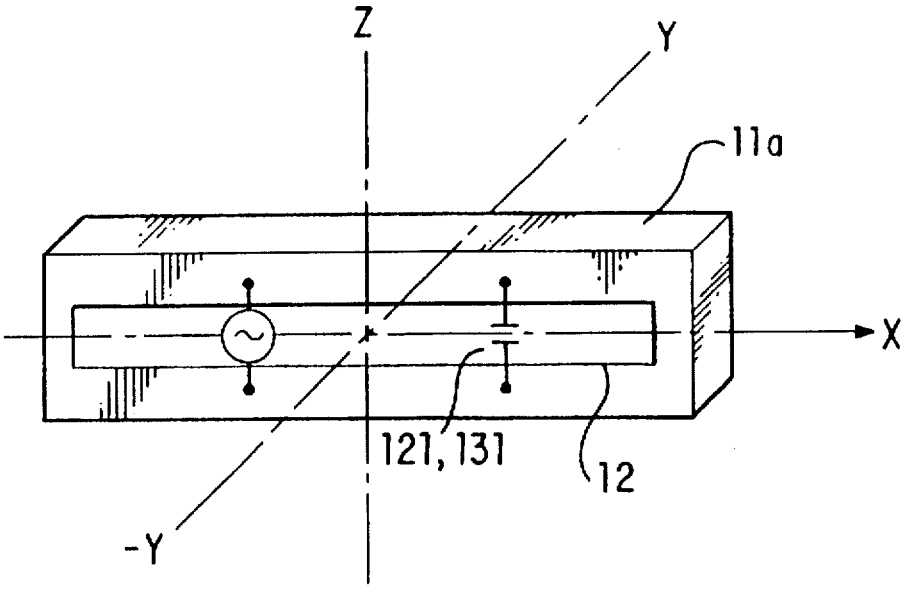
FIG. 4A is a basic structure of the slot antenna device illustrated in FIG. 1A.
Figure 4B:
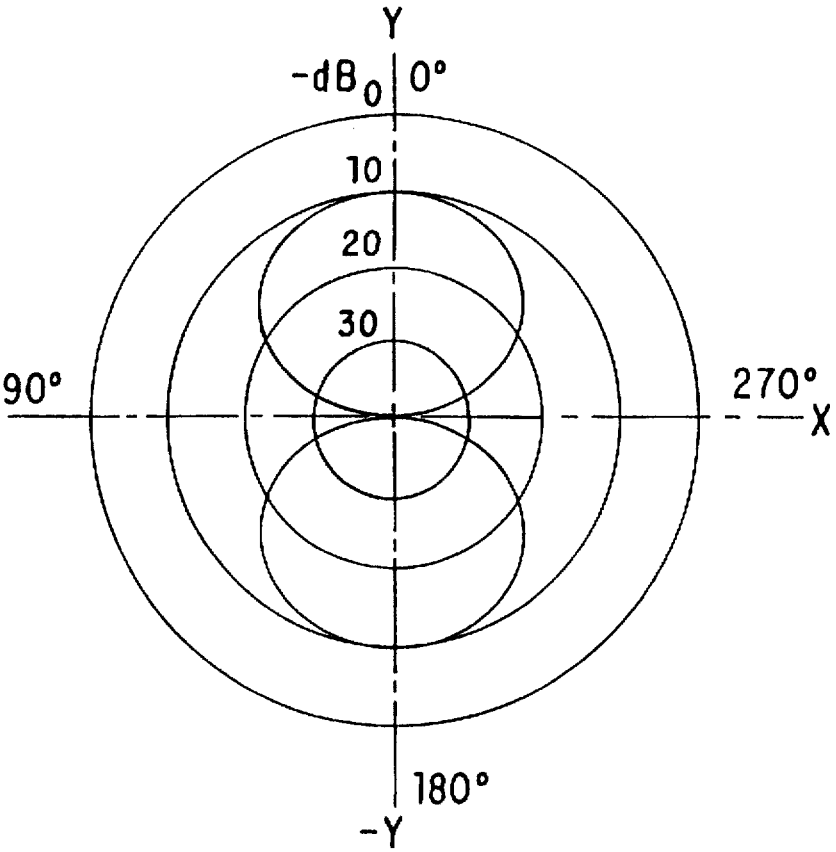
FIG. 4B is a graph illustrating the directivity characteristics of the FIG. 1A antenna.
Figure 8:
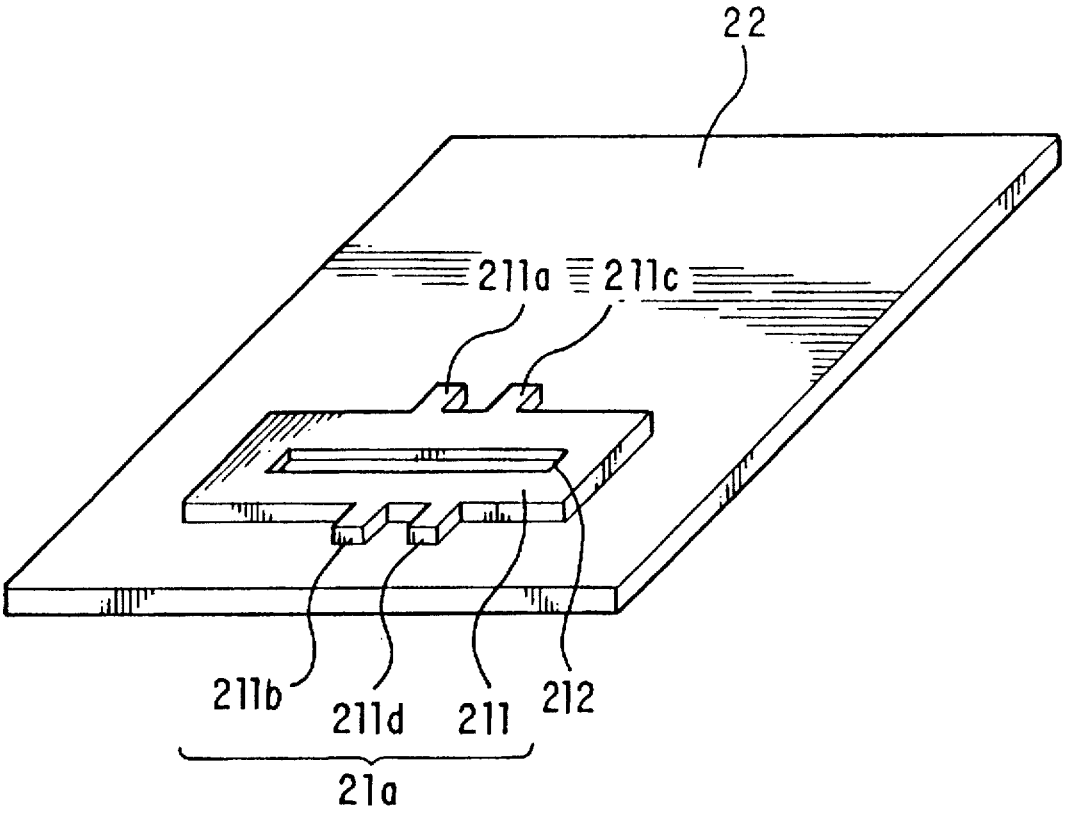
FIG. 8 illustrates the configuration of an antenna body in a portable wireless apparatus (slot antenna device) and a circuit substrate that can be provided in the portable wireless apparatus according to a second embodiment of the invention.

In the portable wireless apparatus formed in this way, as shown in FIG. 4A, if the antenna body 11*a* is placed so that the circuit board 12 extends in the XY plane direction, it shows a directivity characteristic shaped like a FIG. 8 to a perpendicular polarization, as shown in FIG. 4B. This configuration is the same as the directivity characteristics that a dipole antenna placed in a level position shows to a level polarization. That is, the antenna body 11*a* functions as an antenna sensitive to magnetic components in the long direction of the slot 112.

In this embodiment, the circuit board 12 is inserted in the slot 112 of the antenna body 11*a*. This results in a dielectric material (e.g., glass epoxy) having a relative dielectric constant of 4.4 being filled in the slot 112 because the circuit board 12 includes such dielectric material. Accordingly, received signals are apparently shortened in proportion to the square root of the dielectric constant of the dielectric material in the slot 112, and the effective length of the antenna body 11*a* is increased. As a result, signals of long wavelength can be received even if the antenna body 11*a* is miniaturized and thinned. Conversely, with respect to signals having the same wavelength, the antenna body 11*a* can be miniaturized and thinned compared to conventional dipole antennas, for example. Accordingly, a portable wireless apparatus can be made as a notebook-type portable device and can be contained inside a wristwatch case, for example.

Although the slot 112 of this embodiment is formed by cutting out the center of the electrically conductive plate 111, it is possible to bend a metal wire material (into the shape of a loop, for example) and to use the inside of the bent metal wire as the slot. 112. Additionally, instead of holding together firmly the terminals 111*a* to 111*d* in fixing and connecting the antenna body 11*a* and the circuit board 12, it is possible to directly solder the inner peripheral edge of the slot 112 of the electrically conductive plate 111 on the conductor pattern of the circuit board 12.

First Modification of the First Embodiment

Figure 5:
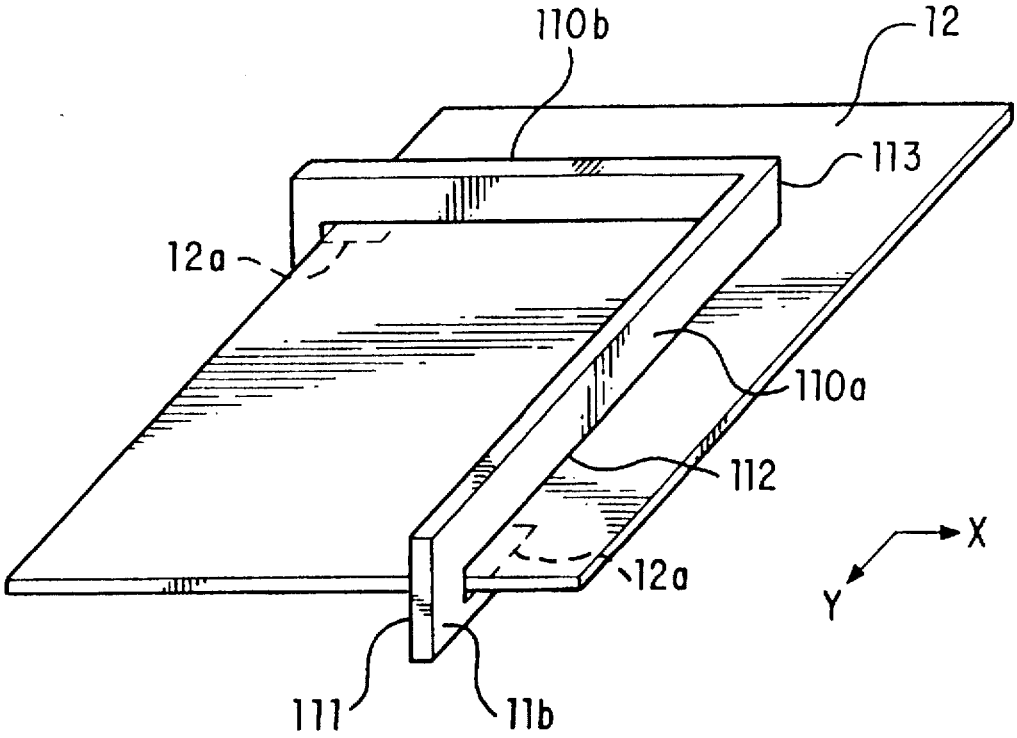
FIG. 5 illustrates the configuration of an antenna body in a portable wireless apparatus (slot antenna device) and a circuit substrate that can be provided in a portable wireless apparatus according to a first modification of the first embodiment.

FIG. 5 illustrates the configuration of an antenna body in a portable wireless apparatus (slot antenna device) according to a first modification of the first embodiment. Note that since in this embodiment and the following embodiments the basic structure is the same as in the first embodiment, the same reference numerals are used to identify parts having a common function, and the detailed explanation and illustration will be omitted.

An antenna body 11*b* in this embodiment has a bent part 113 in the lengthwise center of an electrically conductive plate 111. The electrically conductive plate 111 is bent at a right angle in a plane direction of the plate 111 at the bent part 113, and forms an L shape having a portion 110*a* extending in the Y direction and a portion 110*b* extending in the X direction. A circuit substrate 12 (copper-clad glass epoxy laminate) in which a wireless apparatus circuit is formed is inserted in a slot 112, which opens in two directions. Since in this embodiment, the electrically conductive plate 111 does not have terminals, the inner peripheral edge of the slot 112 of the electrically conductive plate 111 and the circuit board 12 are directly soldered to each other.

In the antenna body 11*b* constructed in this way, since it is bent in an L shape, the slot 112 faces in two (perpendicular) directions. Accordingly, the antenna body 11*b* in this embodiment has a high sensitivity to both X and Y directions. Additionally, since the antenna body 11*b* can detect both a vertical polarization and a horizontal polarization with the circuit board 12 as a standard face, the antenna body 11*b* can detect magnetic components and can also detect electrical components perpendicular to the magnetic components at right angles. Hence, this antenna device has a high sensitivity.

The antenna body 11b formed from the bent electrically conductive plate 111 can be lengthened within the space that the circuit board 12 occupies (that is, it is longer than the FIG. 1 body 11a for similarly sized circuit boards due to the bend), therefore it can receive electromagnetic waves in the frequency band of relatively long wavelength.

In this embodiment, the end of the antenna body 11b projects from the circuit board 12 to the outer periphery. As shown by a dotted line in FIG. 5, it is possible to contain the antenna body 11b completely within the circuit board 12 without changing the configuration of the antenna body 11b and the slot 112 by forming a notch 12a in the circuit board 12, which will receive the end of the antenna body 11b. Alternatively, the antenna body 11b can be connected at the surface and back of the circuit board 12 making use of a through-hole of the circuit board 12. Such a structure can be applied to the first embodiment and to its modifications described hereinafter.

Second Modification of The First Embodiment

Figure 6:
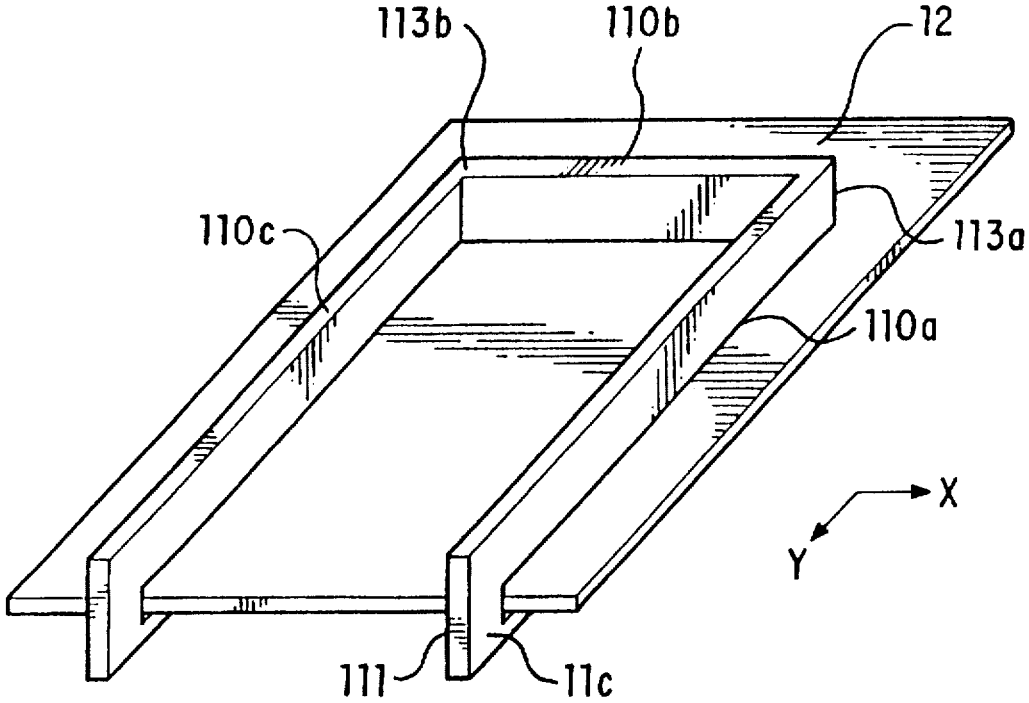
FIG. 6 illustrates the configuration of an antenna body in a portable wireless apparatus (slot antenna device) and a circuit substrate according to a second modification of the first embodiment.

FIG. 6 illustrates the configuration of an antenna body in a portable wireless apparatus (slot antenna device) according to a second modification of the first embodiment.

An antenna body 11c in this embodiment has two bent parts 113a and 113b in the electrically conductive plate 111. At each of the bent parts 113a and 113b the electrically conductive plate 111 is bent at a right angle to the plane of plate 111, and has a portion 110a (a first leg portion) extending in the Y direction, a portion 110b (a connecting portion) extending in the X direction, and a portion 110c (a second leg portion) extending again in the Y direction.

A circuit substrate 12 in which a wireless apparatus circuit is formed is inserted in a slot 112 of the antenna body 11c. In this embodiment, since the electrically conductive plate 111 also does not have terminals, the inner peripheral edge of the slot 112 of the electrically conductive plate 111 and the circuit board 12 are directly soldered to each other.

Since the antenna body 11c formed in this way is bent in two places, the antenna body 11c can be lengthened further without enlarging the circuit board 12. Accordingly, the antenna body 11c is appropriate for transmitting and/or receiving electromagnetic waves in the frequency band of relatively long wavelength. Moreover, because the antenna body 11c and the circuit board 12 are fixed at the parts 110a and 110c extending in the Y direction and the part 110b extending in the X direction, the circuit board 12 does not become separated from the antenna body 11c even when impact and so on are applied thereto.

In this embodiment, if the antenna body 11c is placed along the outer peripheral edge of the circuit board 12 (for example, if portions 110a–110c were located along respective peripheral edges of board 12), the antenna body 11c can be lengthened even further and is advantageous for transmitting and/or receiving electromagnetic waves in the frequency band of relatively long wavelength. Since tuning frequency is determined by the length of the periphery of the slot 112, the length of the antenna body 11c, and the length and/or width of the circuit board 12 are set depending on the desired tuning frequency.

Third Modification of The First Embodiment

Figure 7:
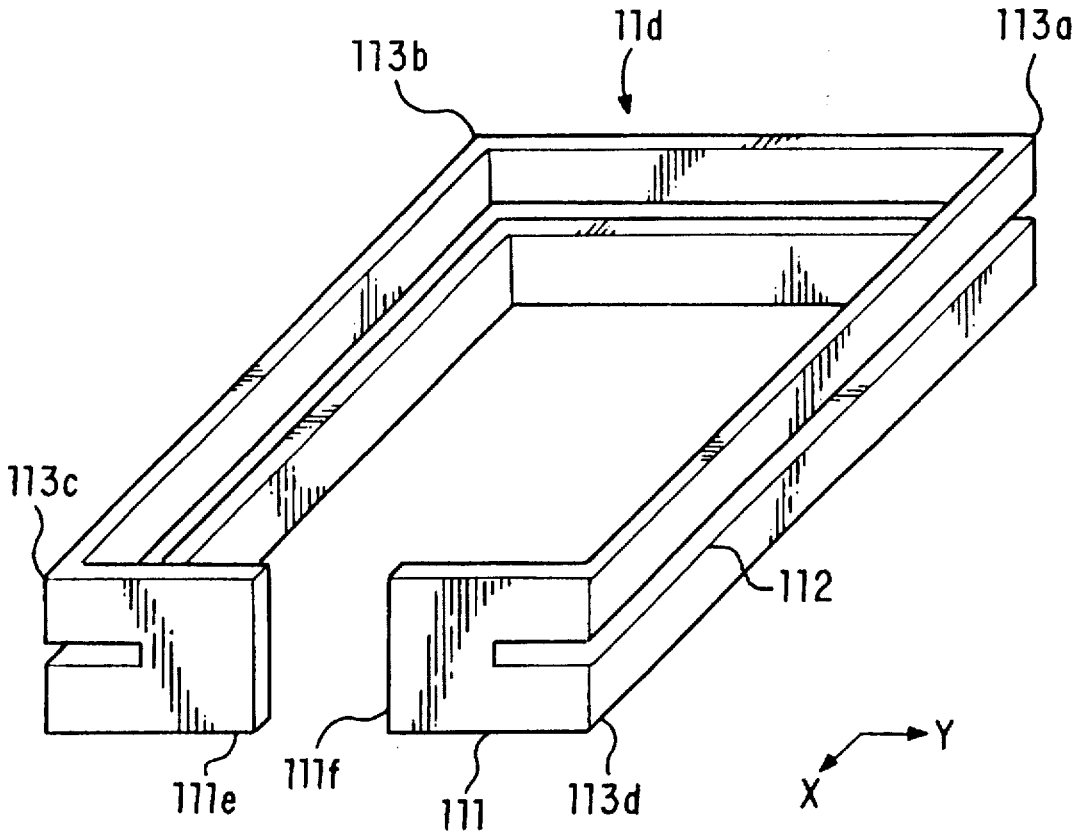
FIG. 7 illustrates the structure of an antenna body in a portable wireless apparatus (slot antenna device) according to a third modification of the first embodiment.

FIG. 7 schematically illustrates the structure of an antenna body of a portable wireless apparatus (slot antenna device) according to a third modification of the first embodiment.

An antenna body lid in this embodiment has four bent parts 113a, 113b, 113c and 113d on the electrically conductive plate 111. The electrically conductive plate 111 is bent at a right angle to the plane of plate 111 at each bent part to form an approximately rectangular configuration. In this embodiment, a circuit board 12 in which a wireless apparatus circuit is formed is inserted in a slot 112; however, the illustration of the circuit board is omitted in FIG. 7 for simplicity.

The antenna body lid formed in this way is bent in four places, therefore the antenna body lid can be further lengthened without enlarging the circuit board 12. Additionally, the antenna body lid can be fixed firmly on the circuit board 12. The antenna body lid can be ring-shaped by connecting ends 111e and 111f. In this case, the length of the slot 112 is determined according to the frequency and wavelength of electromagnetic waves to be transmitted or received.

Of course, it also is possible to form a rectangular shaped antenna device by bending a plate 111 in three locations.

Second Embodiment

FIG. 8 illustrates the configuration of an antenna body of a portable wireless apparatus (slot antenna device) according to a second embodiment, and a circuit board.

An antenna body 21a of a portable wireless apparatus (slot antenna device) also includes an electrically conductive plate member 211 that has a slot 212 formed across the center of the electrically conductive plate 211. This structure also functions as a slot antenna. The electrically conductive plate 211 has four terminals 211a to 211d projecting from its outer peripheral edge. The antenna body 21a with such a structure is contained in a case of a wireless apparatus together with a circuit substrate (board) 22 (copper-clad glass epoxy laminate) in which a wireless apparatus circuit is formed through which transmitting and/or receiving is performed.

In this embodiment, the antenna body 21a is placed parallel to the circuit substrate 22. In this state, by soldering each of the terminals 211a to 211d to a conductor pattern of the circuit substrate 22, the antenna body 21a is fixed on the circuit substrate 22 and is electrically connected with a tuning capacitance element and the wireless apparatus circuit formed on the circuit substrate.

The antenna body 21a constructed in this way, being extremely thin, is appropriate for being placed in a thin portable wireless apparatus, such as card-type pager or a pocket TV, for example. Additionally, the conductor pattern formed in the circuit substrate 22 functions as a reflecting plate located at the back of the antenna body 21a. The reflecting plate results in the antenna body 21a having a high sensitivity to electromagnetic waves directed from the top of the antenna body 21a.

When the terminals 211a to 211d are not provided, the electrically conductive plate 211 and the conductor pattern of the circuit board 22 can be directly soldered to each other. In this case, the tuning capacitance element is placed on the outer peripheral side of the electrically conductive plate 211, or on the top of the slot 212 or on the top of the electrically conductive plate 211.

First Modification of Second Embodiment

Figure 9:
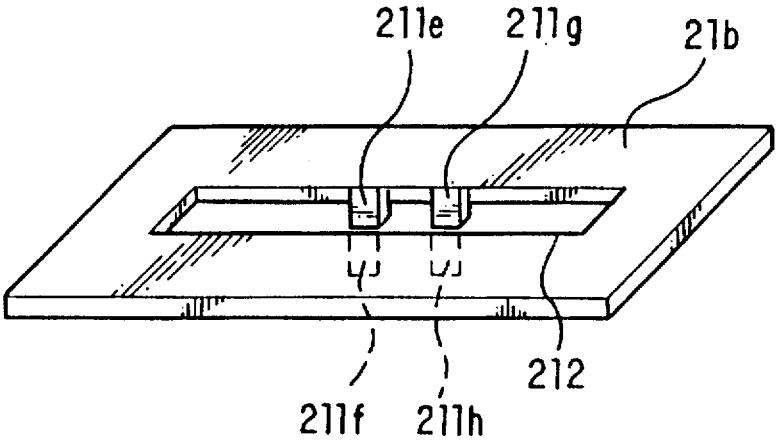
FIG. 9 illustrates the configuration of an antenna body in a portable wireless apparatus (slot antenna device) according to a first modification of the second embodiment.

In the second embodiment, the antenna body 21a can be joined to the circuit board 22. Alternatively, as in an antenna body 21b shown in FIG. 9, it is possible to project terminals 211e to 211h downwardly from the periphery edge of the slot 212 and to solder the terminals 211e to 211h on the conductor pattern of the circuit board 22. In this case, since a gap can be formed between the circuit board 22 and the antenna body 21, a circuit element can be mounted between the circuit board 22 and the antenna body 21b. In other words, the miniaturization of the circuit board 22 can be realized by making use of the gap between the antenna body 21b and the circuit board 22 as a space for mounting parts.

Second Modification of the Second Embodiment

Figure 10:
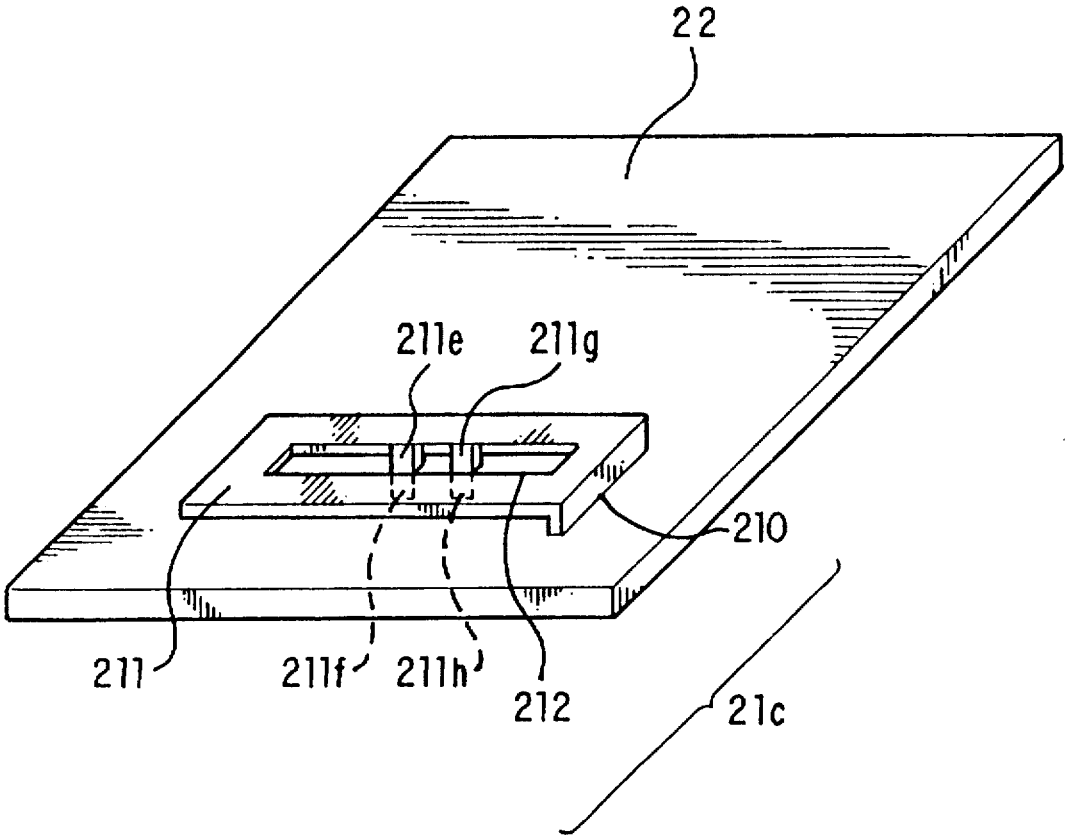
FIG. 10 illustrates the configuration of an antenna body in a portable wireless apparatus (slot antenna device) and a circuit substrate according to a second modification of the second embodiment.

As in an antenna body 21*c* shown in FIG. 10, it is possible to project terminals 211*e* to 211*h* downward from the inner peripheral edge of slot 212, and to bend an end 210 of the electrically conductive plate 211 in an L shape. The terminals 211*e* to 211*h* and the end 210 are soldered on an electrically conductive pattern of the circuit board 22.

In the antenna body 21*c* formed in this way, it is possible to mount parts between the antenna body 21*c* and the circuit board 22 and their bond strength improves. In the antenna body 21*c*, both the detection of magnetic components by a mode functioning as a slot antenna and the detection of electric components by a mode functioning as an inverted F type antenna can be carried out by making the conductor pattern on which the end 210 is soldered ground electric potential and by adjusting the position of a feed point to the antenna body 21*c* by controlling the positions of the terminals 211*e* to 211*h*.

Third Modification of Second Embodiment

Figure 11:
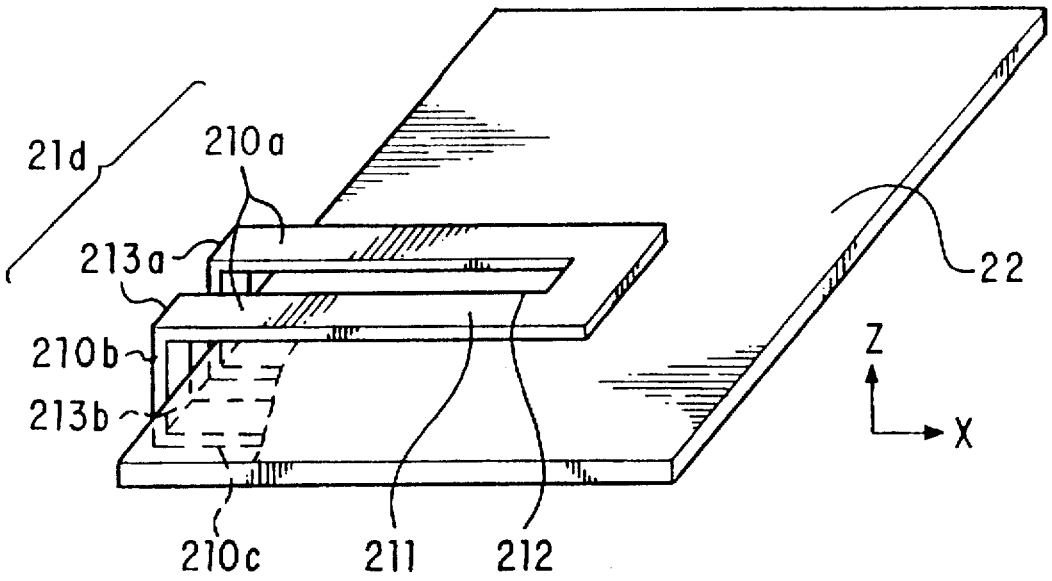
FIG. 11 illustrates the configuration of an antenna body in a portable wireless apparatus (slot antenna device) and a circuit substrate according to a third modification of the second embodiment.

FIG. 11 illustrates the configuration of an antenna body in a portable wireless apparatus (slot antenna device) according to a third modification of the second embodiment.

In an antenna body 21*d* in this embodiment, an electrically conductive plate 211 is placed parallel to a circuit board 22, and a conductor pattern formed in the circuit board 22 is used as a reflecting plate. The antenna body 21*d* has two bent parts 213*a* and 213*b* in two places in the lengthwise direction of the electrically conductive plate 211. The electrically conductive plate 211 is bent at a right angle to the plane of plate 211. The bent portions 213*a*, 213*b* are located adjacent to an outer peripheral side of the circuit board 22. Accordingly, a top 210*a* (a first leg portion) of antenna body 21*d* extends in the X direction, a side 210*b* (a connecting portion) extends in the Z direction and a bottom 210*c* (a second leg portion) also extends in the X direction. The circuit board 22 is held between the top 210*a* and the bottom 210*c* and directly contacts top 210*a* and bottom 210*c*. The electrically conductive plate 211 and the circuit board 22 can be electrically connected by directly soldering them, or by making use of terminals bent in a predetermined configuration for example.

The antenna body 21*d* constructed in this way can be lengthened within the space that the circuit board 22 occupies. The antenna body 21*d* has a slot 212 both at the top surface and the bottom surface of the circuit board 22. The conductor pattern formed in the circuit board 22 functions as a reflecting plate to the antenna body 21*d* both at the top and the bottom. Hence, the antenna body 21*d* has a high sensitivity toward both the top and the bottom.

Fourth Modification of Second Embodiment

Figure 12:
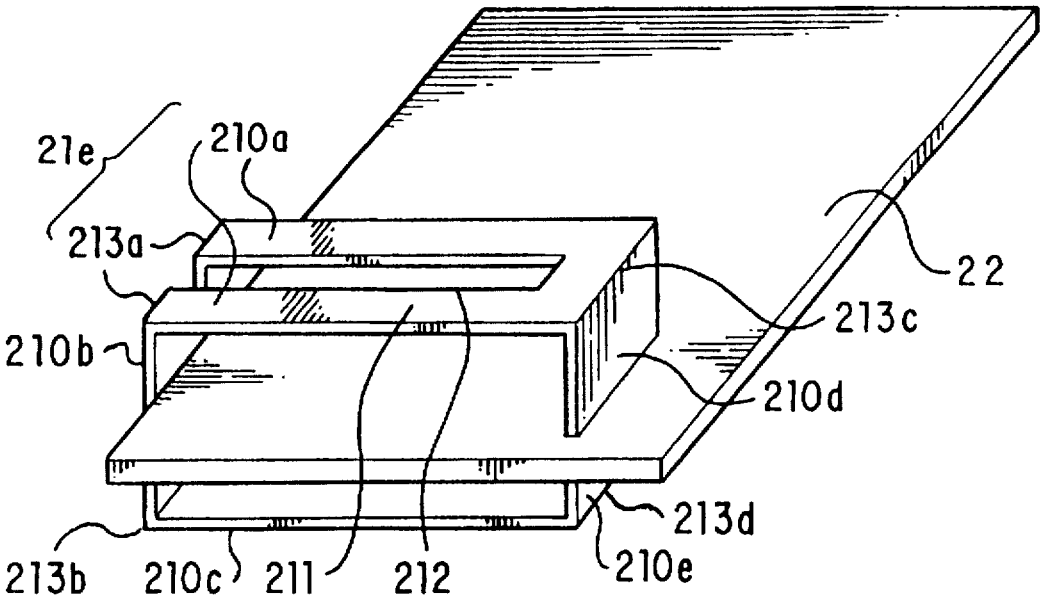
FIG. 12 illustrates the configuration of an antenna body in a portable wireless apparatus (slot antenna device) and a circuit substrate according to a fourth modification of the second embodiment.

If a gap in which to mount parts is to be secured between the antenna body 21*d* and the circuit board 22, as in an antenna body 21*e* shown in FIG. 12, bent parts 213*c* and 213*d* in addition to bent parts 213*a* and 213*b* are formed on the ends of both leg portions. Ends 210*d* and 210*e* of the electrically conductive plate 211 are bent toward the circuit board 22 at the bent parts 213*c* and 213*d*. In this case, parts can be mounted between the antenna body 21*e* and the circuit board 22, and the antenna body 21*e* can be firmly fixed on the circuit board 22 and can be electrically connected with the circuit board 22 by soldering the ends 210*d* and 210*e* of the antenna body 21*e* on a conductor pattern of the circuit board 22.

Third Embodiment

Figure 13:
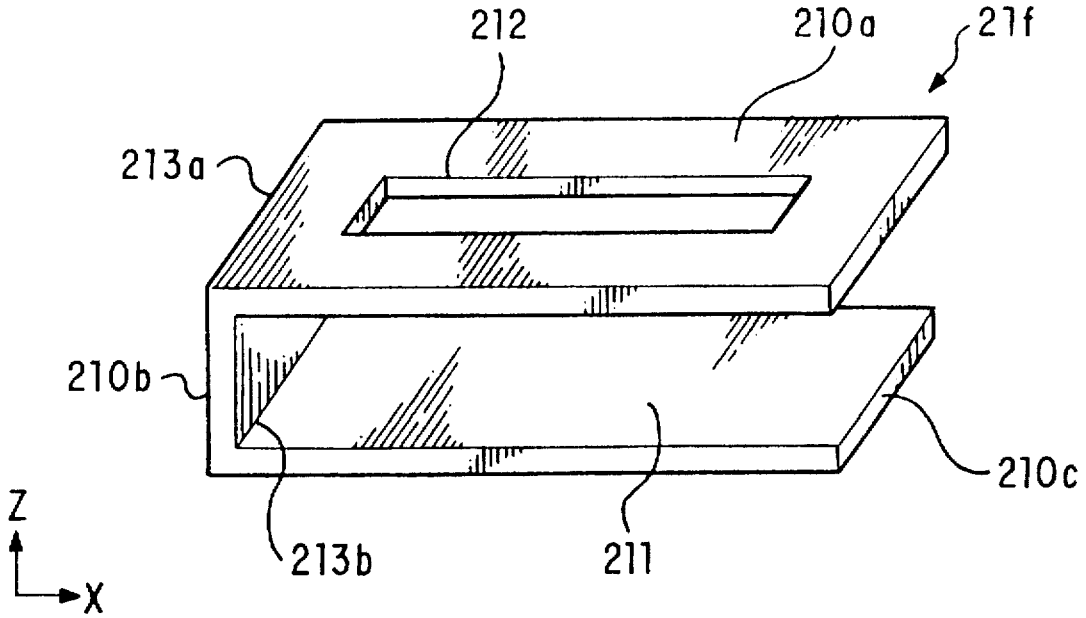
FIG. 13 illustrates the configuration of an antenna body in a portable wireless apparatus (slot antenna device) according to a third embodiment of the invention.

FIG. 13 illustrates an antenna body of a portable wireless apparatus (slot antenna device) according to a third embodiment of the invention.

An antenna body 21*f* of this embodiment has two bent parts 213*a* and 213*b* in two places along the length of an electrically conductive plate 211 in which a slot 212 is formed. The electrically conductive plate 211 is bent at a right angle to a plane of plate 211 at the bent parts 213*a* and 213*b*. Accordingly, the antenna body 21*f* has a top 210*a* (first leg portion) extending in the X direction, a side 210*b* (connecting portion) extending in the Z direction and a bottom 210*c* (second leg portion) extending in the X direction. In this embodiment, only the top 210*a* of the electrically conductive plate 211 has the slot 212, and the other parts do not have a slot.

The bottom 210*c* acts as a reflecting plate for the top 210*a* in which the slot 212 is formed. Hence, high sensitivity to electromagnetic waves is provided from the top side. In the antenna body 21*f*, by inserting a circuit board in which a wireless apparatus circuit is formed in the slot 212, it is possible to obtain the same effect as when the slot 212 is filled with a dielectric material as detailed above with respect to the first embodiment. A circuit board 22 can be placed between the top 210*a* and the bottom 210*c*, when it is preferred to apply electrical ground potential to the bottom 210*c*.

The antenna body 21*f* can be composed of separate parts by connecting the top 210*a*, the side 210*b*, and the bottom 210*c* by means of screw connectors, solder, etc.

First Modification of Third Embodiment

Figure 14:
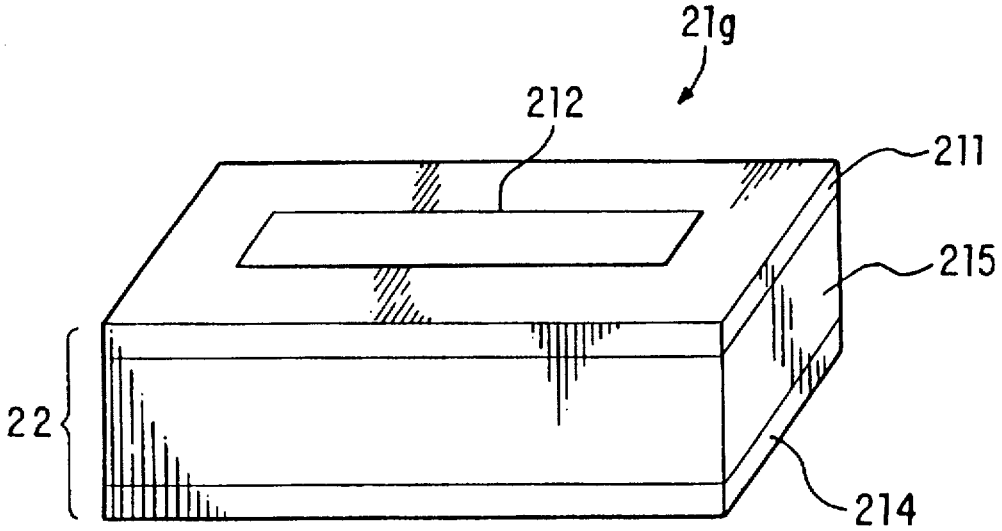
FIG. 14 illustrates the configuration of an antenna body in a portable wireless apparatus (slot antenna device) and a circuit substrate that can be provided in a portable wireless apparatus together with the antenna body according to a first modification of the third embodiment.

FIG. 14 illustrates the structure of an antenna body of a portable wireless apparatus (slot antenna device) according to a first modification of the third embodiment.

An antenna body 21*g* of this embodiment, has a reflecting plate 214 located behind an electrically conductive plate 211 in which a slot 212 is formed. In this embodiment, a dielectric material 215 is filled between the electrically conductive plate 211 and the reflecting plate 214. The slot 212 of the electrically conductive plate 211 also is filled with the dielectric material 215. Accordingly, the antenna body 21*g* can respond to relatively long wavelength even if the slot 212 is short. Additionally, the reflecting plate 214 serves to improve the sensitivity from the top side.

The antenna body 21*g* formed in this way can be formed by adhering the electrically conductive plate 211 and the reflecting plate 214 on the top and bottom of the dielectric material 215 which was shaped in predetermined configuration. In the antenna body 21*g*, the electrically conductive plate 211 and the reflecting plate 214 can be electrically connected along a side of the dielectric material 215.

Second Modification of Third Embodiment

The antenna body 21*g* shown in FIG. 14 can be formed by fabricating an electrically conductive plate 211, a reflecting plate 214, and the dielectric material 215 all on one circuit board 22. That is, a two-sided printed board (two-sided copper-clad glass epoxy laminate) is employed as the circuit board 22, and the electrically conductive plate 211 in which the slot 212 is formed is formed as a conductor pattern by patterning a metal layer (copper layer) on the top surface of board 22. The reflecting plate 214 is left on the bottom surface of circuit board 22 as a conductor pattern in an area opposed to the electrically conductive plate 211. If the antenna body 21*g* is formed in this way, an antenna body 21*g* can be easily manufactured in which the dielectric material 215 (e.g., glass epoxy) is filled between the electrically conductive plate 211 and the reflecting plate 214, and inside of the slot 212.

It is possible to form the electrically conductive plate 211 and the reflecting plate 214 as a conductor pattern by employing a flexible tape as the circuit substrate 22 on both sides of which a metal layer is printed, and by patterning the metal layer in a predetermined configuration on both sides of the tape. In this case, since the antenna body 21*g* can be bent freely, the antenna body 21*g* can be placed in a narrow space such as the inside of a wristwatch.

Fourth Embodiment

Figure 15:
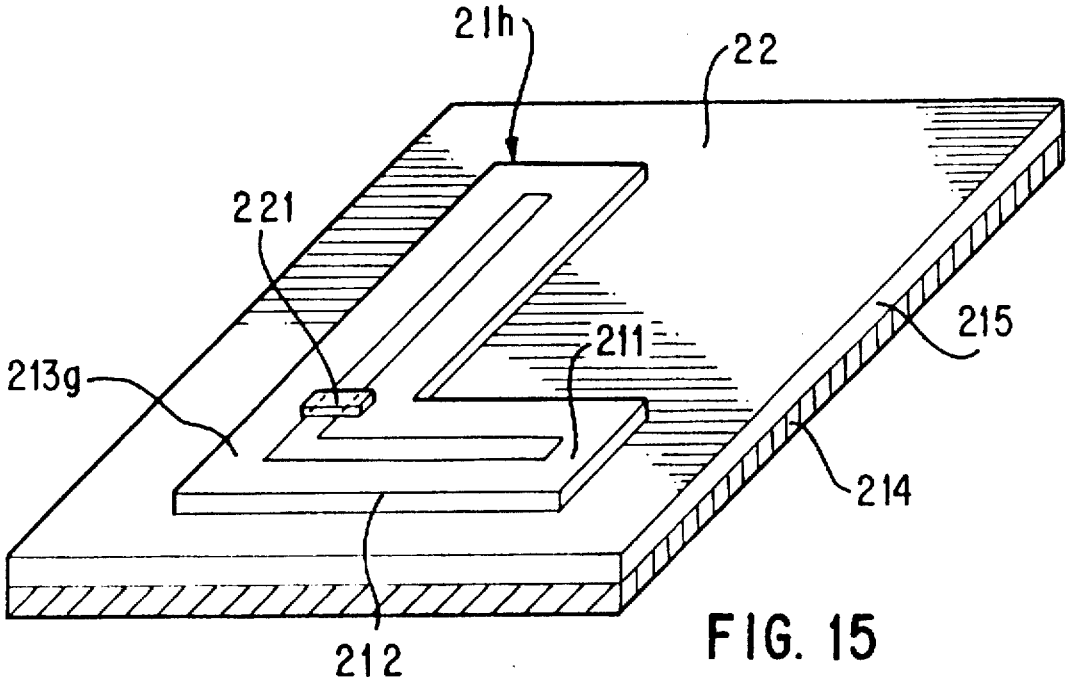
FIG. 15 illustrates the configuration of an antenna body in a portable wireless apparatus (slot antenna device) and a circuit substrate that can be placed in a portable wireless apparatus together with the antenna body according to a fourth embodiment of the invention.

FIG. 15 illustrates the structure of an antenna body and a circuit board of a portable wireless apparatus (slot antenna device) according to a fourth embodiment of the invention.

An antenna body 21*h* of this embodiment also employs a two-sided printed substrate as a circuit board 22, and patterns a metal layer conductor pattern on both sides to form an electrically conductive plate 211 in which a slot 212 is formed and a reflecting plate 214. Since the electrically conductive plate 211 is formed by patterning the metal layer on a circuit board 22, it can be formed in a variety of configurations (i.e., shapes). Accordingly, the electrically conductive plate 211 and the slot 212 can be formed with a bend so that it has an L shape including a bend part 213*g*. Thus, it is easy to form the slotted plate with a longer size on a circuit substrate 22 having a predetermined area. The electrically conductive plate 211 can be designed to have a configuration that corresponds to a configuration of a case for a portable wireless apparatus, for example. For instance, the electrically conductive plate 211 can have a rectangular form by placing four bends in it, or it can have a circular outer periphery by forming it with one continuous bend.

In this embodiment, since the antenna body 21*h* is part of the circuit board 22, the device can be miniaturized and thinned. In particular, when the outer periphery of the circuit board 22 and the electrically conductive plate 211 are circular, they are appropriate for being contained in a circular case for a wristwatch. Additionally, since the electrically conductive plate 211 itself is a conductor pattern, a tuning capacitance element (capacitor) 221 can be mounted on the top of the electrically conductive plate 211 across the slot 212.

It also is possible to make use of a through-hole formed in the circuit board 22 to electrically connect the electrically conductive plate 211 and the reflecting plate 214.

The reflecting plate 214 is opposed to the electrically conductive plate 211 and has an area larger than the area of the conductive plate 211. Ground electric potential can be applied to the reflecting plate 214.

Figure 16:
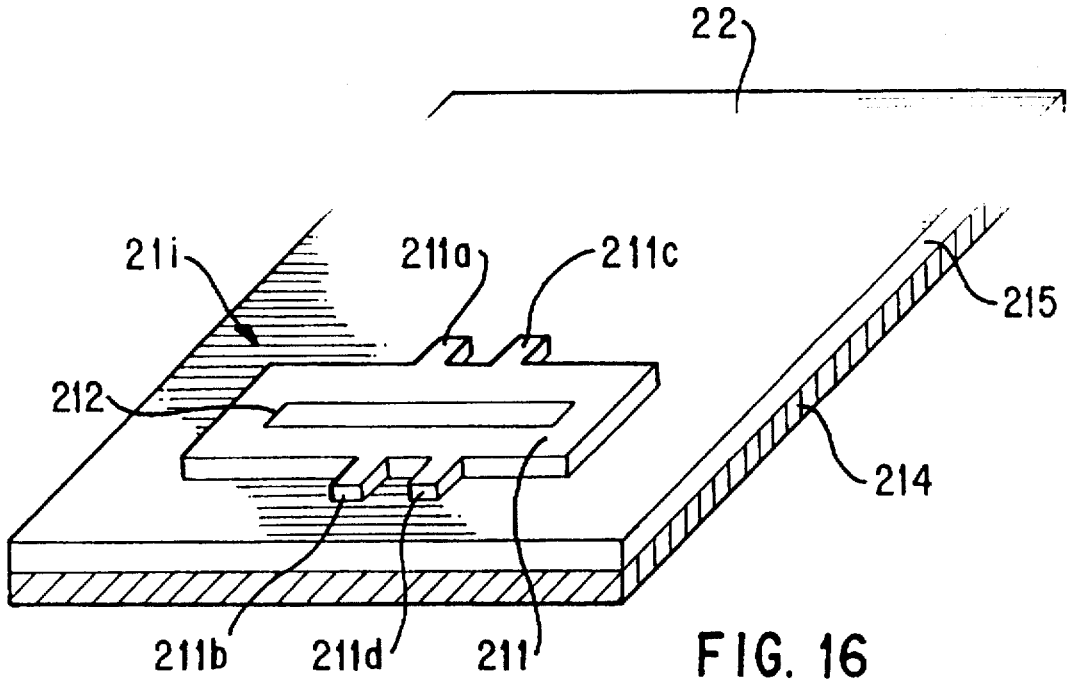
FIG. 16 illustrates the configuration of an antenna body in a portable wireless apparatus (slot antenna device) and a circuit substrate according to a first modification of the fourth embodiment.

It is possible to compose either the electrically conductive plate 211 or the reflecting plate 214 of the conductor pattern of the circuit board 22, as shown in an antenna body 21*i* in FIG. 16. That is,. in the antenna body 21*i*, the electrically conductive plate 211 is formed separate from the circuit board 22, and then is fixed on an opposite surface of the circuit board 22 from the reflecting plate 214. The reflecting plate 214 is composed of a pattern formed in a metal layer on the back of the circuit board 22. The electrically conductive plate 211 has terminals 211*a* to 211*d* on its outer peripheral side. Terminals 211*a* to 211*d* are soldered on the conductor pattern of the circuit board 22.

If a multi-layer board having four or six metal layers is employed in the fourth embodiment, the electrically conductive plate or the reflecting plate can be composed of any of these metal layers.

Fifth Embodiment

Figure 17:
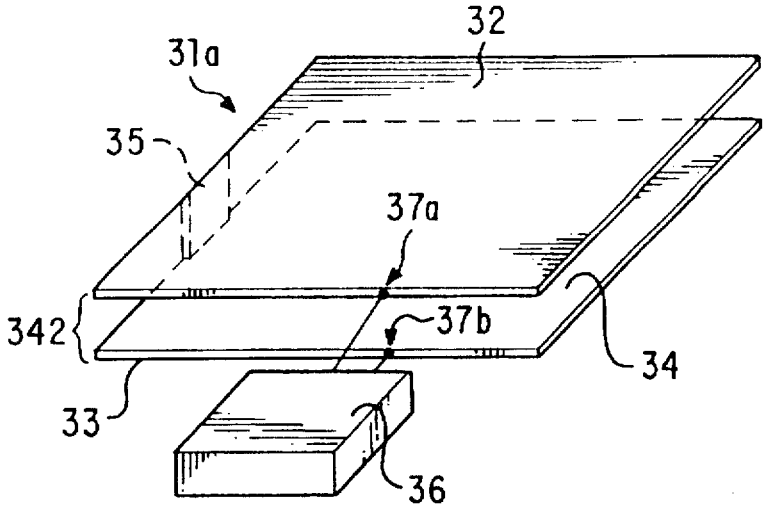
FIG. 17 illustrates the structure of a main part of a portable wireless apparatus (slot antenna device) according to a fifth embodiment of the invention.

FIG. 17 illustrates the structure of an antenna body of a portable wireless apparatus (slot antenna device) according to a fifth embodiment of the invention.

In an antenna body 31*a* of this embodiment, a first rectangular electrically conductive plate 32 and a second rectangular electrically conductive plate 33 are placed parallel to each other and spaced from each other by a predetermined gap 34. Metal plates can be employed as the first and second electrically conductive plates 32 and 33. In addition, for instance, an electrically conductive thin film deposited on the inside of a plastic case of a portable wireless apparatus can be used as the conductive plates. The material is not limited as long as it has a sufficiently high electrical conductivity.

The first and second electrically conductive plates 32 and 33 are electrically connected by a short circuit plate 35 (a connecting portion) at an edge portion on one side, and at a neighboring edge portion, a wireless apparatus circuit block 36, in which a wireless apparatus circuit is formed, is electrically connected at feed points 37*a* and 37*b*.

The antenna body 31*a* formed in this way has, on the outer periphery side of the first and second electrically conductive plates 32 and 33, a slot 342 formed by the gap 34. The slot 342 starts from the forming position of the short circuit plate 35, passes along the outer periphery of the first and second electrically conductive plates 32 and 33 and returns to the short circuit plate 35. This structure functions as a slot antenna.

Furthermore, the slot 342 is open in every direction (in a plane containing the plates), with the width of the slot corresponding to the distance between the first and second electrically conductive plates 32 and 33 (i.e., the width of gap 34). Accordingly, compared with a slot antenna in which a slot extends in a straight line in the antenna body 31*a* of this embodiment a mode results in which the slot antenna acts compoundly. Therefore both electromagnetic components are effectively received or transmitted, and the antenna body 31*a* has high antenna gain.

Figure 18:
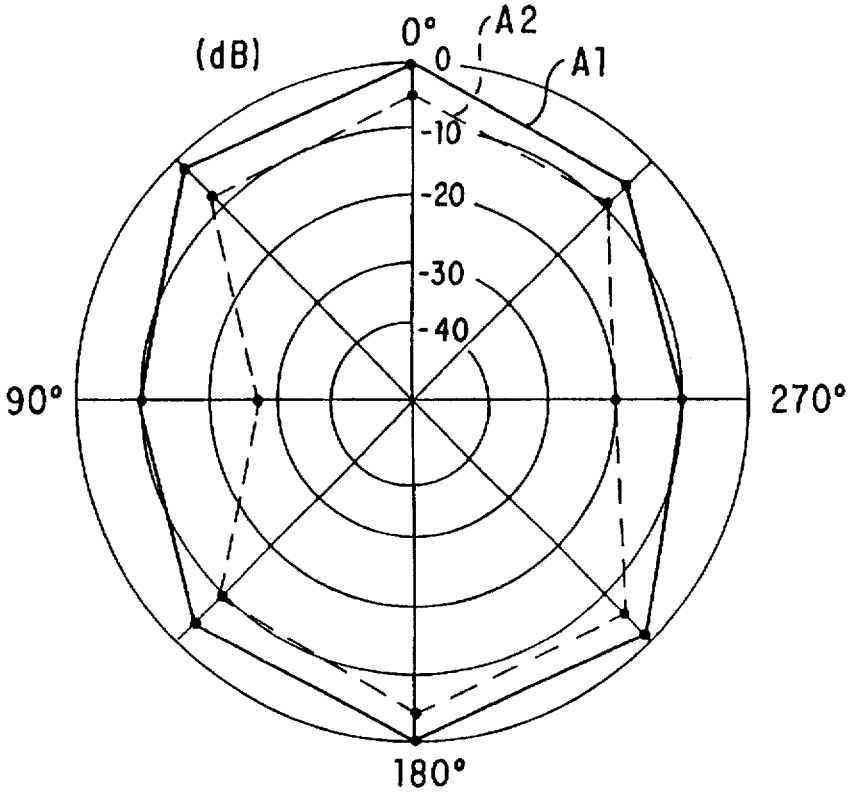
FIG. 18 is a graph showing the directivity characteristics of the portable wireless apparatus (slot antenna device) illustrated in FIG. 17.

In FIG. 18, the directivity characteristics of the antenna body 31*a* of this embodiment, which has the slot 342 in the shape of a rectangle, are shown by a solid line A1, and is compared with the directivity characteristics (shown by a dotted line A2) of a slot antenna having a same size slot extending in a straight line. Each value is shown by a relative ratio to the maximum value of the antenna gain, and is a directivity on a horizontal plane. Comparing these directivity characteristics, the antenna body 31*a* of this embodiment has an antenna gain improved by several dB over the antenna gain of in the comparative antenna. Additionally, the antenna body 31*a* in this embodiment has a pattern that is more round than that of the comparative antenna, and the null point is on the decrease and is nearly isotropic. Accordingly, the antenna body 31*a* in this embodiment can be thinned and also is highly sensitive; therefore, it is appropriate for a portable wireless apparatus.

For the purpose of reinforcing the antenna body 31*a*, a plastic material, for example, can be inserted in the gap 34. Particularly, if a dielectric material with a low loss is inserted in the gap 34, the slot 342 is filled with the dielectric material and the wavelength of received electromagnetic waves can be apparently shortened. Consequently, even if the antenna body 31*a* is small-sized, it can receive electromagnetic waves having a relatively long wavelength. Furthermore, antenna gain can be improved without enlarging the antenna body 31*a*.

By setting the position of the feed points 37*a* and 37*b* in an optimum position based on the impedance matching of the antenna body 31*a* and the wireless apparatus circuit block 36, high sensitivity can be obtained. The short circuit part 35 can have any structure. For example, it can be a part of each of the electrically conductive plates, or it can be fixed to each electrically conductive plate by means of a screw connector, for example.

First Modification of Fifth Embodiment

Figure 19:
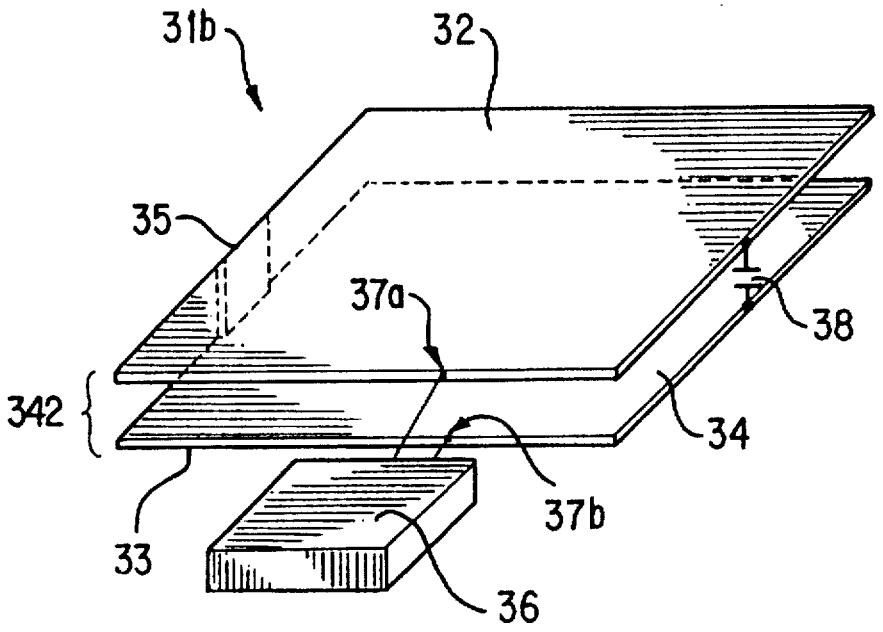
FIG. 19 illustrates the structure of a main part of a portable wireless apparatus (slot antenna device) according to a first modification of the fifth embodiment.

FIG. 19 illustrates the structure of an antenna body of a portable wireless apparatus (slot antenna device) according to a first modification of the fifth embodiment.

In an antenna body 31*b* in this embodiment, the first rectangular electrically conductive plate 32 and the second rectangular electrically conductive plate 33 are placed parallel to each other across a predetermined gap 34, and a short circuit plate 35 is formed at an edge portion on one side to electrically connect the first and second electrically conductive plates 32 and 33.

In this embodiment, a tuning capacitance element 38 is electrically connected with the first and second electrically conductive plates 32 and 33 across slot 342 at an edge portion of plates 32, 33 on the opposite side of the short circuit plate 35. This connecting position corresponds to the position in which the tuning capacitance element (capacitor) 38 is electrically connected with the antenna body 31*b* in the lengthwise center of the slot 342.

Figure 20A:
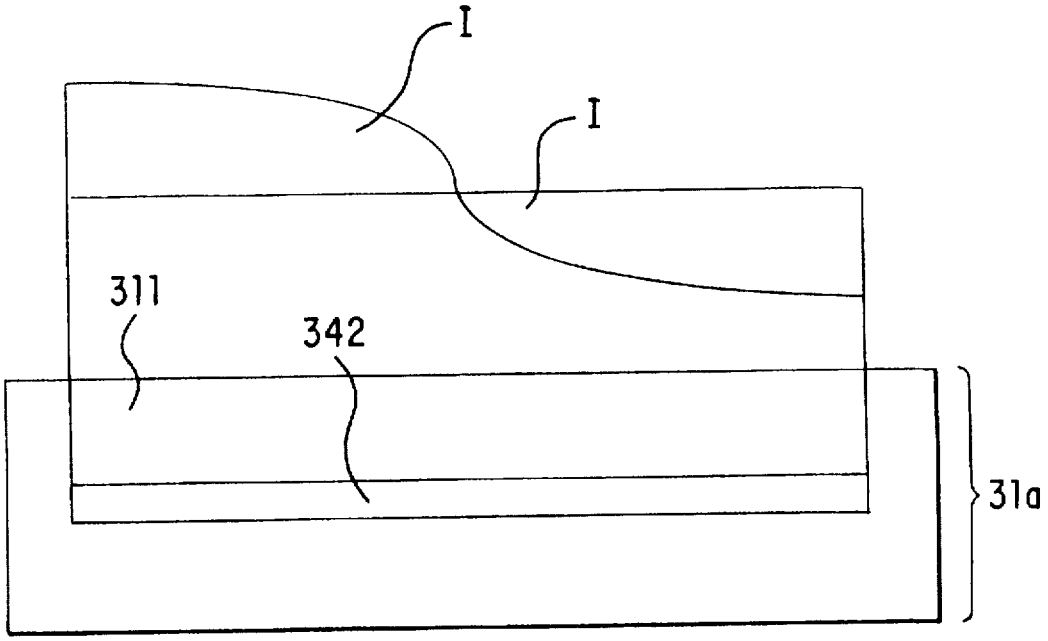
FIG. 20A illustrates the operation of the portable wireless apparatus (slot antenna device) shown in FIG. 17.
Figure 20B:
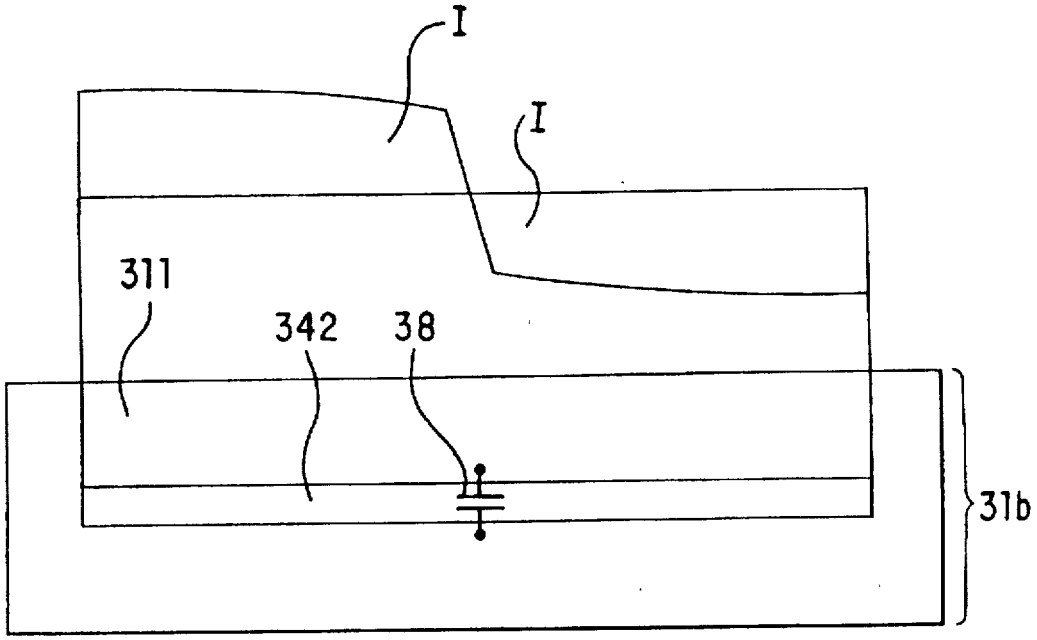
FIG. 20B illustrates the operation of the portable wireless apparatus (slot antenna device) shown in FIG. 19.

The tuning capacitance element 38 makes the antenna body 31*b* tune even if the outer peripheral size of the first and second electrically conductive plates 32 and 33, that is, the length of the slot 342, is shorter than the size corresponding to a half wavelength of the frequency being used. Furthermore, the tuning capacitance element 38 is placed in the lengthwise center of the slot 342 (as measured from short circuit plate 35) to maximize antenna gain. The reason will be explained below by comparing the antenna body according to the fifth embodiment and the antenna body 31*b* in this first modification of the fifth embodiment. As shown in FIG. 20A, in the antenna body 31*a* (FIG. 17) not employing a tuning capacitance element, because the amplitude I of an electric current generates a sine wave, the antenna body resonates when half wavelength and the length of the slot 342 coincide. On the other hand, as shown in FIG. 20B, in the antenna body 31*b* having the tuning capacitance element 38 in the lengthwise center of the slot 342 (FIG. 19), since the amplitude I of an electric current changes suddenly due to the tuning capacitance element 38, the wavelength is apparently shortened. Additionally, as shown in FIG. 20B, if the tuning capacitance element 38 is placed in the center of the slot 342, an electric current can be balanced on both sides. Accordingly, the maximum electric current can be applied to the antenna body 31*b*, hence improving the antenna gain.

Second Modification of Fifth Embodiment

Figure 21:
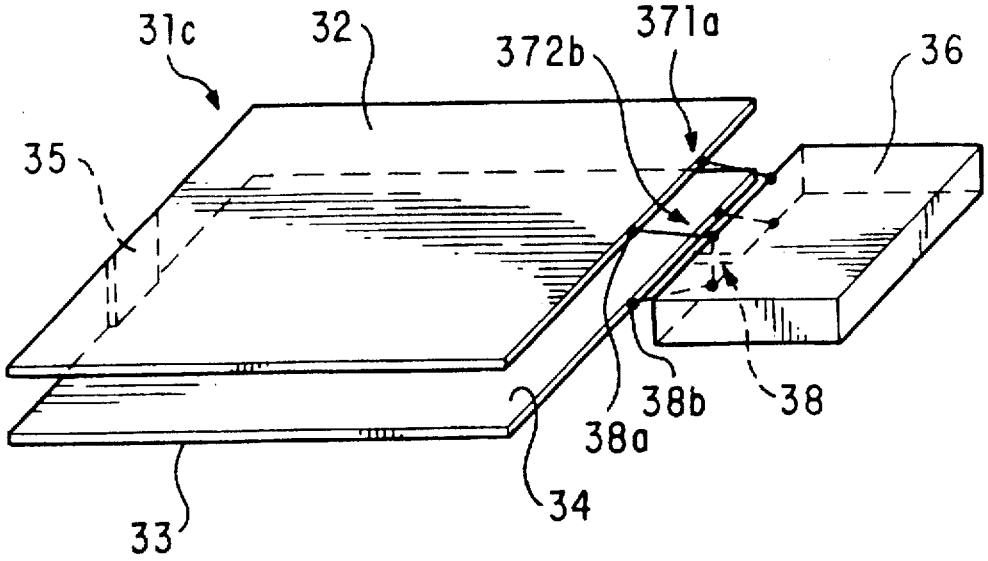
FIG. 21 illustrates the configuration of an antenna body in a portable wireless apparatus (slot antenna device) and a circuit block placed in the portable wireless apparatus together with the antenna body according to a second modification of the fifth embodiment.

FIG. 21 illustrates the structure of an antenna body of a portable wireless apparatus (slot antenna device) according to a second modification of the fifth embodiment.

In an antenna body 31*c* of this embodiment, compared with the first modification of the fifth embodiment, feed points 371*a* and 372*b* are placed on the same edge portion side of plates 32, 33 as connection points 38*a* and 38*b* of the tuning capacitance element 38. That is, in this embodiment, since the feed points 371*a* and 372*b* and the connection points 38*a* and 38*b* are side by side, the tuning capacitance element 38 can be mounted in a wireless apparatus circuit block 36 together with the wireless apparatus circuit. Accordingly, the number of parts in the assembly can be decreased and the structure can be simplified, hence reducing costs.

Third Modification of Fifth Embodiment

Figure 22:
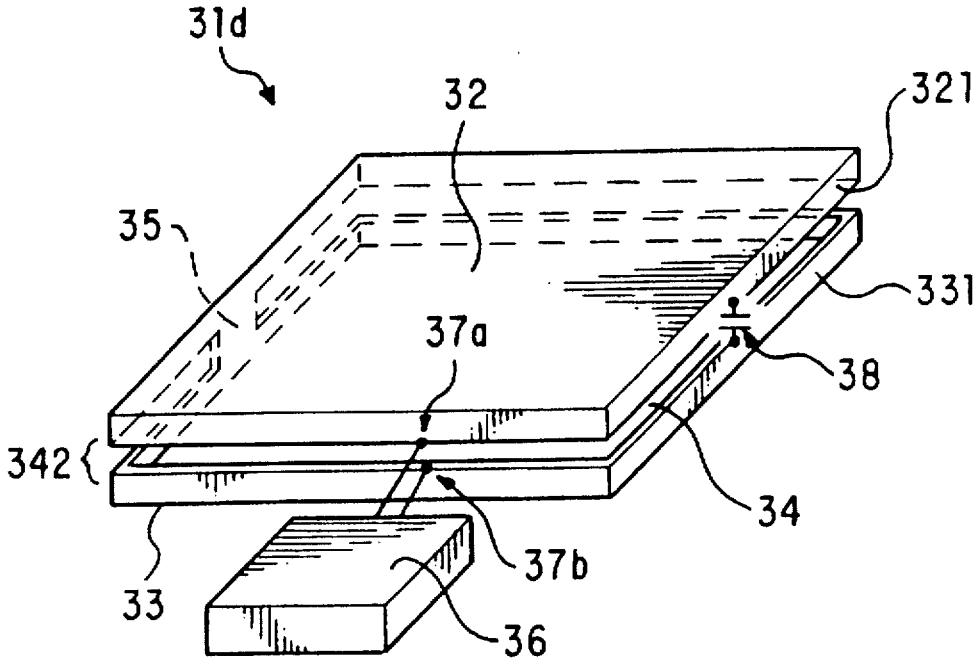
FIG. 22 illustrates the structure of an antenna body in a portable wireless apparatus (slot antenna device) according to a third modification of the fifth embodiment.

FIG. 22 illustrates an antenna body of a portable wireless apparatus (slot antenna device) according to a third modification of the fifth embodiment.

In an antenna body 31*d* in this embodiment, compared with the first modification of the fifth embodiment, the outer periphery of the first electrically conductive plate 32 is bent toward the second electrically conductive plate 33 to form a side portion 321, while the outer periphery of the second electrically conductive plate 33 is bent toward the first electrically conductive plate 32 to form a side portion 331. A gap 34 and a slot 342 are arranged between a lower edge of the side portion 321 and an upper edge of the side portion 331.

In the antenna body 31*d* formed in this way, the width of the gap 34 (width of the slot 342) determines the tuning frequency. For example, when the frequency is high (wavelength is short), the width of the slot 342 needs to be reduced. For example, when the frequency is 100 mMHz, the appropriate width of the slot 342 is about 5 to 9 mm. When the frequency is 300 mMHz, the appropriate width of the slot 342 is about 3 to 7 mm. The width of the slot 342 can be adjusted without changing the basic design conditions in the antenna body 31*d* in this embodiment.

In other words, in this embodiment, the width of the slot 342 can be adjusted to an appropriate value (to a tuning frequency) by establishing the side portions 321 and 331 in the first and second electrically conductive plates 32 and 33 without changing the opposition distance of the first and second electrically conductive plates 32 and 33, or by changing their widths. Accordingly, the tuning frequency can be changed without changing the design of a case for a wireless apparatus main body that contains the first and second electrically conductive plates 32 and 33, the member to fix the first and second electrically conductive plates 32 and 33 to each other, etc.

Fourth Modification of Fifth Embodiment

Figure 23:
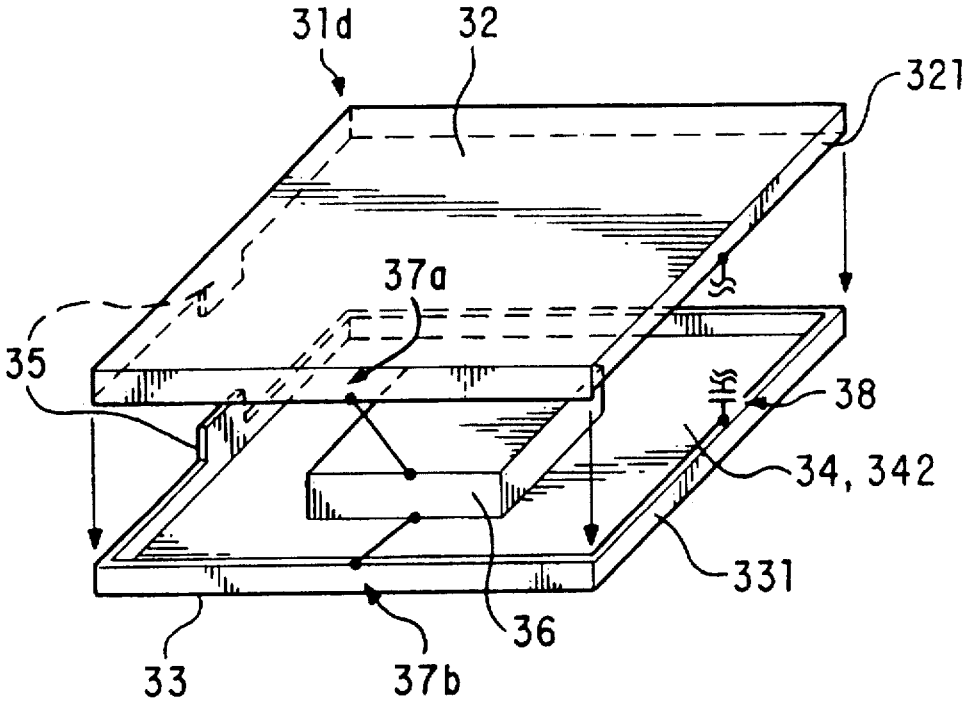
FIG. 23 illustrates the configuration of an antenna body in a portable wireless apparatus (slot antenna device) and a circuit block according to a fourth modification of the fifth embodiment.

FIG. 23 illustrates an antenna body of a portable wireless apparatus (slot antenna device) according to a fourth modification of the fifth embodiment.

In a portable wireless apparatus in this embodiment, compared with the antenna body 31*d* according to the third modification of the fifth embodiment, a wireless apparatus circuit block 36 is placed between the first electrically conductive plate 32 and the second electrically conductive plate 33, not outside the antenna body 31*d*. Consequently, no additional space (area) is required to hold the wireless apparatus circuit block 36. Hence, the portable wireless apparatus can be further miniaturized.

Fifth Modification of Fifth Embodiment

Figure 24A:
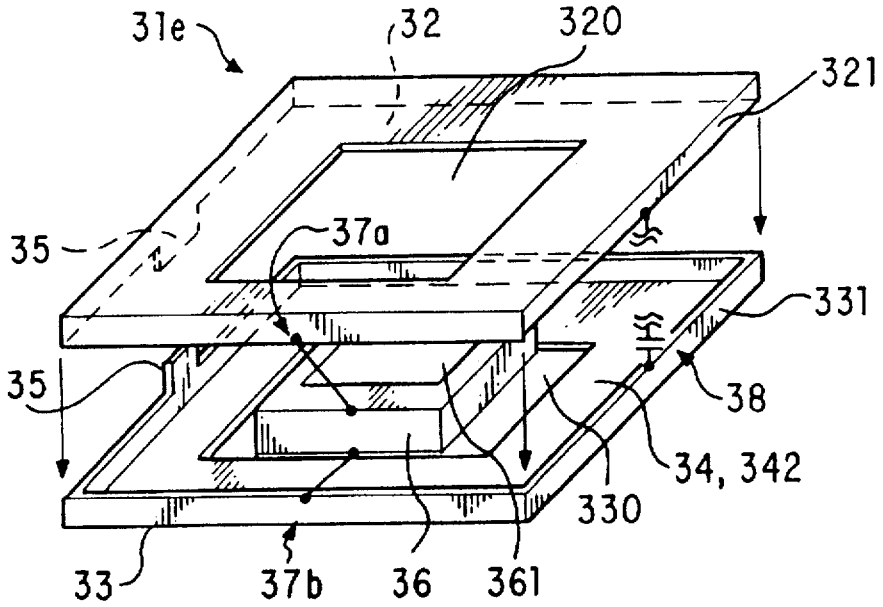
FIG. 24A illustrates the structure of an antenna body in a portable wireless apparatus (slot antenna device) according to a fifth modification of the fifth embodiment.

FIG. 24A illustrates the structure of an antenna body of a portable wireless apparatus (slot antenna device) according to a fifth modification of the fifth embodiment.

An antenna body 31*e* of a portable wireless apparatus in this embodiment, compared with the antenna body according to the fourth modification of the fifth embodiment, has a rectangular aperture 320 in the center of the first electrically conductive plate 32, and a rectangular aperture 330 in the center of the second electrically conductive plate 33. The portable wireless apparatus is miniaturized further by placing a wireless apparatus circuit block 36 in the center between the first electrically conductive plate 32 and the second electrically conductive plate 33. The positions of the apertures 320 and 330 correspond to the position of the wireless apparatus circuit block 36. Since the apertures 320 and 330 are larger than the area occupied by the wireless apparatus circuit block 36, the upper and lower sides of the wireless apparatus circuit block 36 are open (that is, entirely accessible).

In the antenna body 31*e* formed in this way (as in the FIG. 23 antenna body), because the wireless apparatus circuit block 36 is located between the first and second electrically conductive plates 32 and 33, the first and second electrically conductive plates 32 and 33 easily catch noise generated by the wireless apparatus circuit block 36. In the embodiment of FIG. 24A, however, since the apertures 320 and 330 are formed in the position corresponding to the wireless apparatus circuit block 36, the electric field occurring between the first and second electrically conductive plates 32 and 33 is concentrated on the outside of the conductive plates 32 and 33, and does not occur near the wireless apparatus circuit block 36. Consequently, since the noise generated by the wireless apparatus circuit block 36 does not disturb the electric field occurring between the first and second electrically conductive plates 32 and 33, there is little noise influence from the circuit block 36, and antenna gain improves.

Figure 24B:
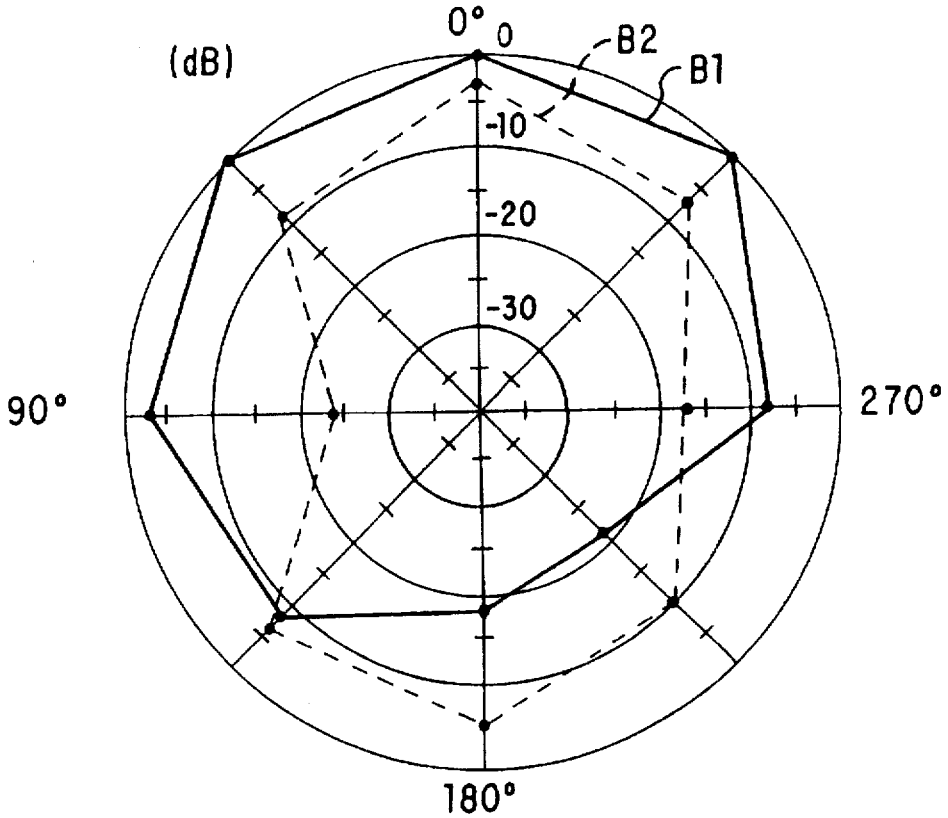
FIG. 24B is a graph showing the directivity characteristics of the FIG. 24A structure.

For instance, the directivity characteristics of the antenna body 31*e* is as shown by dotted line B2 in FIG. 24B. When the antenna body 31*e* in this embodiment is placed in a breast pocket of a user, the directivity characteristic is shown by solid line B1. Each value is shown by a relative ratio to the maximum value of the antenna gain and is a direction on a horizontal plane. Comparing these characteristics, the image effect of a human body improves antenna gain several dB in front of the human body (0° direction), therefore it is suitable for a portable wireless apparatus such as a pager.

As shown in FIG. 24A, if a liquid crystal display panel 361 is placed on the top of the wireless apparatus circuit block 36 and information is displayed thereon, the information can be seen through the aperture 320 of the first electrically conductive plate 32. Since the aperture 330 of the second electrically conductive plate 33 opens the bottom of the wireless apparatus circuit block 36, it is easy to exchange a battery fitted inside the wireless apparatus circuit block 36. Consequently, a wristwatch-type portable wireless apparatus as shown in FIG. 25 can be constructed using the antenna body 31*e*.

Figure 25:
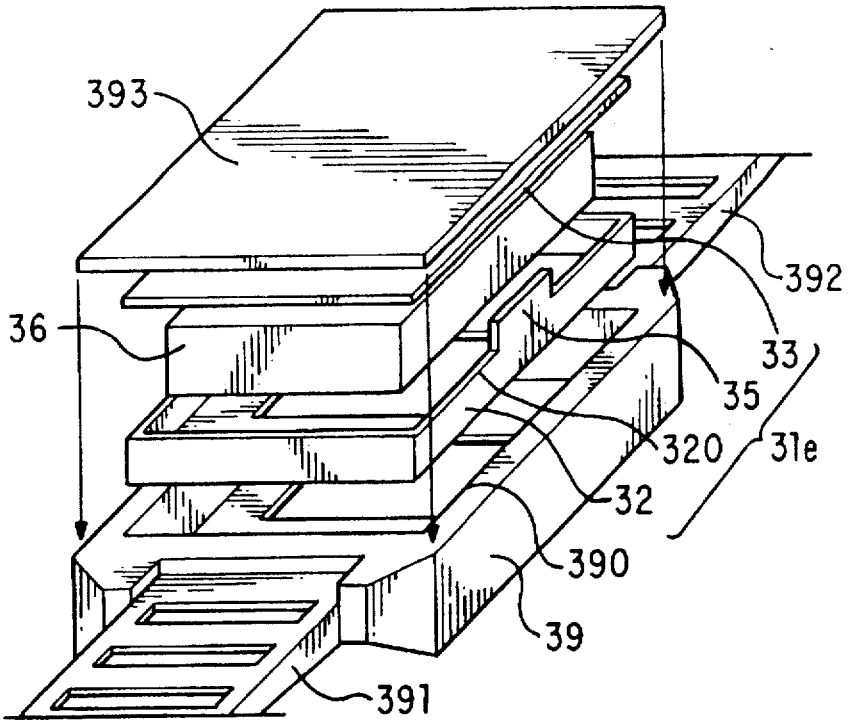
FIG. 25 is an exploded view of a wristwatch-type portable wireless apparatus loaded with the antenna body illustrated in FIG. 24A viewed from the back.

FIG. 25 is an exploded view of the wristwatch-type portable wireless apparatus as viewed from the back. This wristwatch-type portable wireless apparatus has an aperture 390 as a display on the surface of a case 39. Wrist bands 391 and 392 are connected to both sides of the case 39. After the first electrically conductive plate 32, the wireless apparatus circuit block 36, and the second electrically conductive plate 33 are sequentially contained in the case 39, the back of the case 39 is covered with a bottom cover 393 to form the wristwatch-type portable wireless apparatus.

In the wristwatch-type portable wireless apparatus formed in this way, the information displayed on the display device such as the liquid crystal display panel formed on the top of the wireless apparatus circuit block 36 can be seen through the aperture 390 of the case 39 without being obstructed by the first electrically conductive plate 32. Since the antenna body 31*e* is completely covered with the case 39 and the bottom 393, there is no need to consider resistance to corrosion, resistance to abrasion and so on of the material forming the antenna body 31*e*. Accordingly, the antenna body 31*e* can be composed of a metal material with low resistance to corrosion but with high electrical conductivity such as copper to improve antenna gain.

Sixth Modification of Fifth Embodiment

Figure 26:
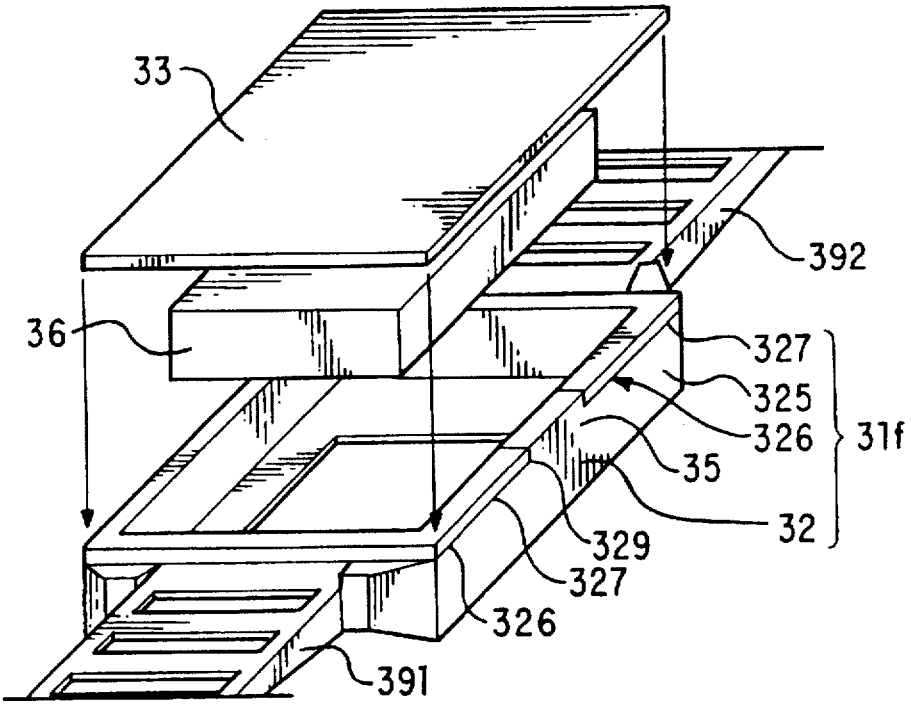
FIG. 26 is an exploded view of a wristwatch-type portable wireless apparatus according to a sixth modification of the fifth embodiment.

FIG. 26 illustrates the structure of a portable wireless apparatus (slot antenna device) according to a sixth modification of the fifth embodiment.

In an antenna body 31*f* of a portable wireless apparatus in this embodiment, the first electrically conductive plate 32 and the second electrically conductive plate 33 are opposed to each other across a slot. The first electrically conductive plate 32 has an aperture 320 in its center and also serves as a case for a wristwatch-type portable wireless apparatus. The second electrically conductive plate 33 also serves as a bottom cover to cover the back of a case forming the wristwatch-type portable wireless apparatus. Accordingly, there is no aperture in the center of the second electrically conductive plate 33, unlike in the fifth modification of the fifth embodiment, but the wireless apparatus can be easily removed at the back of the case (i.e., the first electrically conductive plate 32).

A side portion 325 of the first electrically conductive plate 32 has a cutout 329 with a short circuit part 35 as a protruding convex member remaining in an edge 326. A spacer 327 composed of an insulating material such as plastic is fixed in the cutout 329. Accordingly, if the back of the first electrically conductive plate 32 is covered with the second electrically conductive plate 33 after the wireless apparatus circuit block 36 is contained inside the first electrically conductive plate 32, the slot 342 is maintained because the spacer 327 is located between them. The first electrically conductive plate 32 and the second electrically conductive plate 33 are electrically connected by the short circuit 35. Accordingly, in this embodiment, the antenna body 31*f* having the first electrically conductive plate 32, the spacer 327 and the second electrically conductive plate 33 also functions as a slot antenna.

In the wristwatch-type portable wireless apparatus formed in this way, in which information is displayed on a display device such as a LED, the liquid crystal display panel formed on the top of the wireless apparatus circuit block 36 can be seen through the aperture of the first electrically conductive plate 32 (i.e., the case).

Figure 27A:
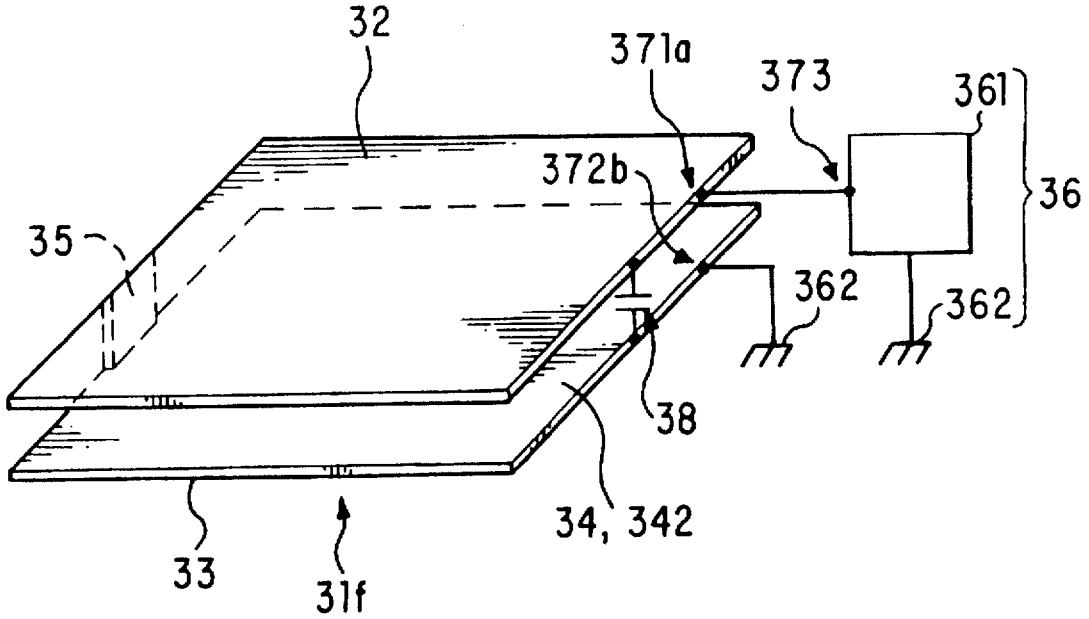
FIG. 27A illustrates an unbalanced circuit formed in the portable wireless apparatus illustrated in FIGS. 17, 19, 21, 22, 23, 24A, 25, 26.

In this embodiment, the antenna body 31*f* and the wireless apparatus circuit block 36 constitute a circuit shown in FIG. 27A. In order to carry out unbalanced feed to the antenna body 31*f*, a feed point 371*a* of the first electrically conductive plate 32 is electrically connected with a feed circuit 361 of the wireless apparatus circuit block 36 through an antenna terminal 373. A feed point 372*b* of the second electrically conductive plate 33 is electrically connected with a ground terminal 362 of the wireless apparatus circuit block 36. In such a connection structure, by changing the set position of the feed points 371*a* and 372*b* at the outer periphery of the first and second electrically conductive plates 32 and 33 and setting the distance between the feed points 371*a* and 372*b* and the tuning capacitance element 38 at optimal conditions, the impedance matching between the antenna body 31*f* and the wireless apparatus circuit block 36 can be realized.

Figure 27B:
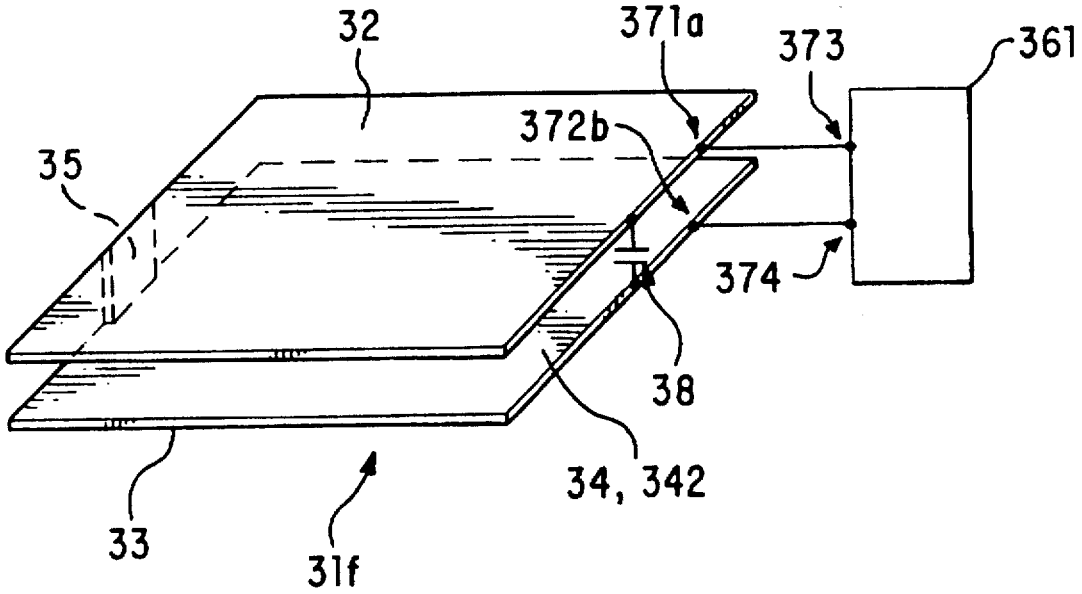
FIG. 27B illustrates a balanced circuit formed in the FIG. 17, 19, 21, 22, 23, 24A, 25, 26 portable wireless apparatus.

On the other hand, in order to carry out balanced feed to the antenna body 31*f*, a circuit shown in FIG. 27B is formed. In this circuit, a feed point 371*a* of the first electrically conductive plate 32 is electrically connected with a feed circuit 361 of the wireless apparatus circuit block 36 through an antenna terminal 373, and a feed point 372*b* of the second electrically conductive plate 33 is electrically connected with a feed circuit 361 of the wireless apparatus circuit block 36 through an antenna terminal 374. In such a connection structure, by changing the set position of the feed points 371*a* and 372*b* at the outer periphery of the first and second electrically conductive plates 32 and 33 and setting the distance between the feed points 371*a* and 372*b* and the tuning capacitance element 38 at optimal conditions, the impedance matching between the antenna body 31*f* and the wireless apparatus circuit block 36 also can be realized.

Sixth Embodiment

Figure 28:
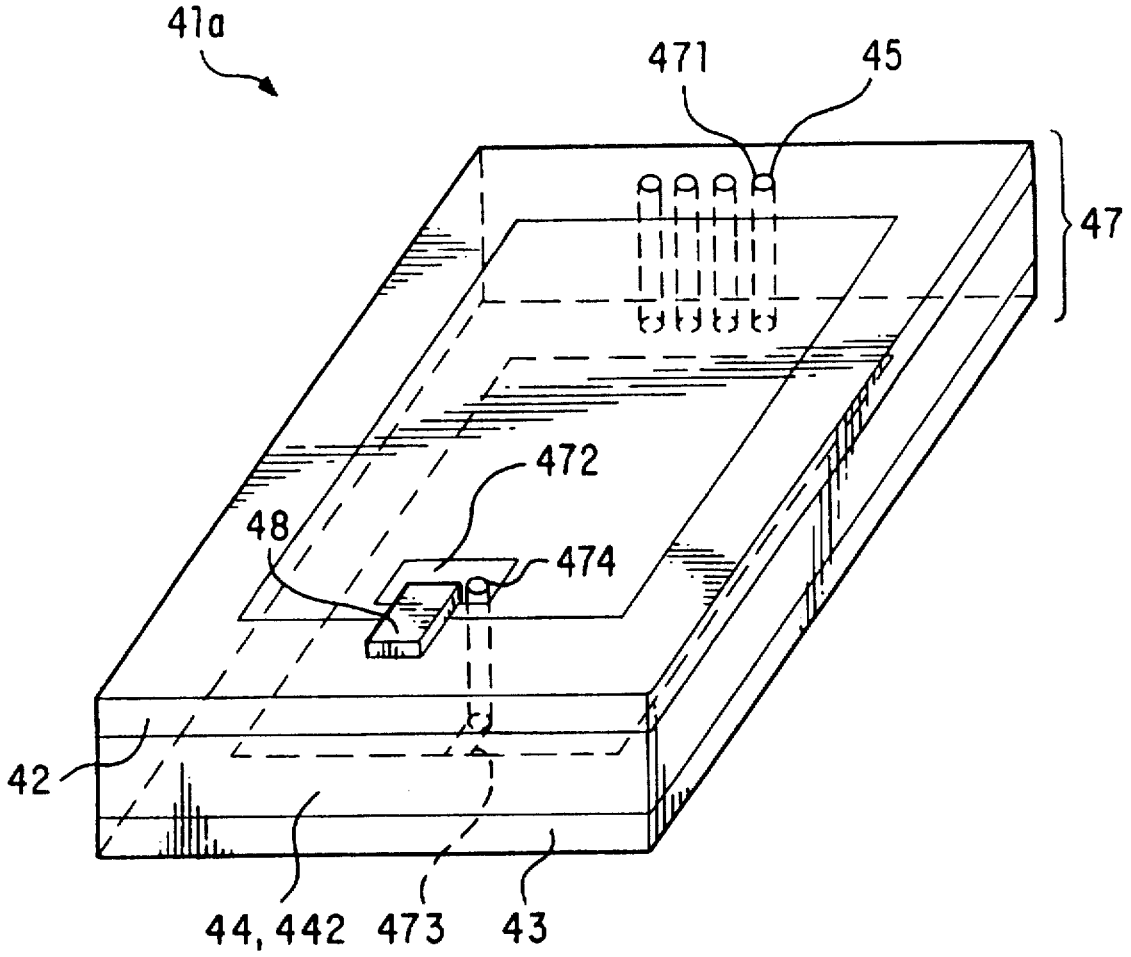
FIG. 28 illustrates the structure of an antenna body according to a sixth embodiment of the invention.

FIG. 28 illustrates the structure of an antenna body of a portable wireless apparatus (slot antenna device) according to a sixth embodiment of the invention.

An antenna body 41*a* in this embodiment has a first electrically conductive plate 42 and a second electrically conductive plate 43 placed parallel to each other across a predetermined gap 44. The first and second electrically conductive plates 42 and 43 are electrically connected to each other by a short circuit 45 at an edge portion on one side. Accordingly, the antenna body 41*a* has a slot 442 formed at the outer periphery of the first and second electrically conductive plates 42 and 43 by the gap 44 extending from the short circuit 45 around the outer periphery of the first and second electrically conductive plates 42 and 43 to the short circuit 45. Consequently, the antenna body 41*a* functions as a slot antenna.

In this embodiment, the first and second electrically conductive plates 42 and 43 are comprised of a conductor pattern made by patterning a metal layer (e.g., a copper layer) on both (top and bottom) sides on the periphery of a circuit board 47 (two-sided copper-clad glass epoxy laminate). Accordingly, the gap 44 is the glass epoxy of the circuit board 47, and the short circuit 45 is a conductive build-up formed inside one or more through-holes 471 of the circuit board 47.

Furthermore, in this embodiment, in order to connect a tuning capacitance element (capacitor) 48 with both of the first and second electrically conductive plates 42 and 43, a conductor pattern 472 is formed inside the first electrically conductive plate 42 on the top surface of the circuit board 47, and a conductor pattern 473 is extended inward from the second electrically conductive plate 43 at the bottom surface of the circuit board 47. The conductor patterns 472 and 473 are electrically connected through a conductive build-up formed inside a through-hole 474 of the circuit board 47. The tuning capacitance element 48 is mounted to the first electrically conductive plate 42 and the conductor pattern 472 on the top surface of the circuit board 47. The tuning capacitance element 48 is a chip capacitor, a varactor diode, etc., and is electrically connected with the first and second electrically conductive plates 42 and 43 over the gap 44 (slot 442) via through hole 474. The connection position of the tuning capacitance element 48 is opposed to the short circuit 45 and corresponds to the lengthwise center of the slot 442 as measured from the short circuit 45.

In the antenna body 41*a* formed in this way, the first and second electrically conductive plates 42 and 43 can have other configurations by changing the patterning configuration of the metal layer on both sides of the circuit board 47, while maintaining the width of the gap 44 (slot 442) uniform. The slot width can be correctly designed by varying the thickness of the circuit board 47. Moreover, since the thin antenna body 41*a* can be formed, it is appropriate for being placed in a portable wireless apparatus such as a pager. The tuning capacitance element 48 also can be mounted as a separate electronic part to constitute the wireless apparatus circuit. Furthermore, since the first and second electrically conductive plates 42 and 43 are conductor patterns patterned along the outer peripheral edge of the circuit board 47, the antenna is long and the wireless apparatus circuit can be placed inside the inner periphery of the conductor patterns.

First Modification of Sixth Embodiment

Figure 29:
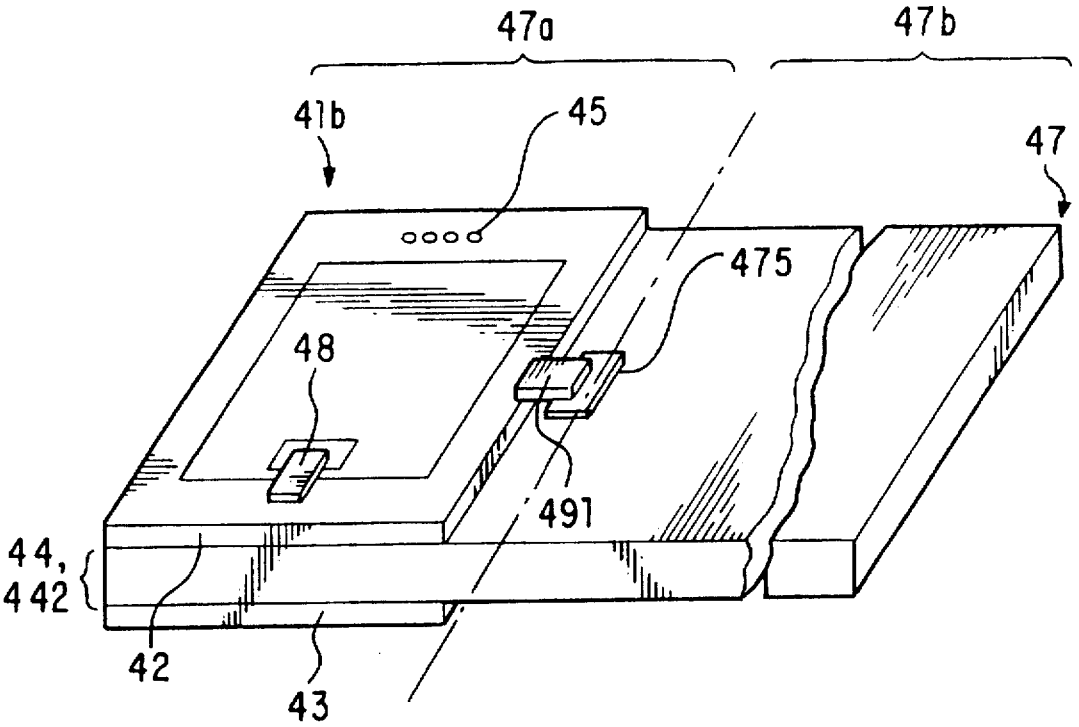
FIG. 29 illustrates the structure of an antenna body according to a first modification of the sixth embodiment.

FIG. 29 illustrates the structure of an antenna body of a portable wireless apparatus (slot antenna device) according to a first modification of the sixth embodiment.

In an antenna body 41*b* in this embodiment, the first and second electrically conductive plates 42 and 43 also are composed of a conductor pattern made by patterning a metal layer on both sides of a circuit board 47 (two-sided printed substrate). Accordingly, a gap 44 which functions as a slot 442 is defined by a glass epoxy substrate of the circuit board 47. A short circuit 45 of the first and second electrically conductive plates 42 and 43 is a conductive build-up formed inside a through-hole formed in the circuit board 47.

In this embodiment, the first and second electrically conductive plates 42 and 43 are formed in a left half 47*a* of the circuit board 47. A right half 47*b* adjacent to the left half 47*a* in a plane direction is used as a formation area of the wireless apparatus circuit. A conductor pattern 475 is formed in the boundary between the right half 47*b* and the left half 47*a*, and a coupling capacitor 491 is mounted to the conductor pattern 475 and the first electrically conductive plate 42.

Figure 30:
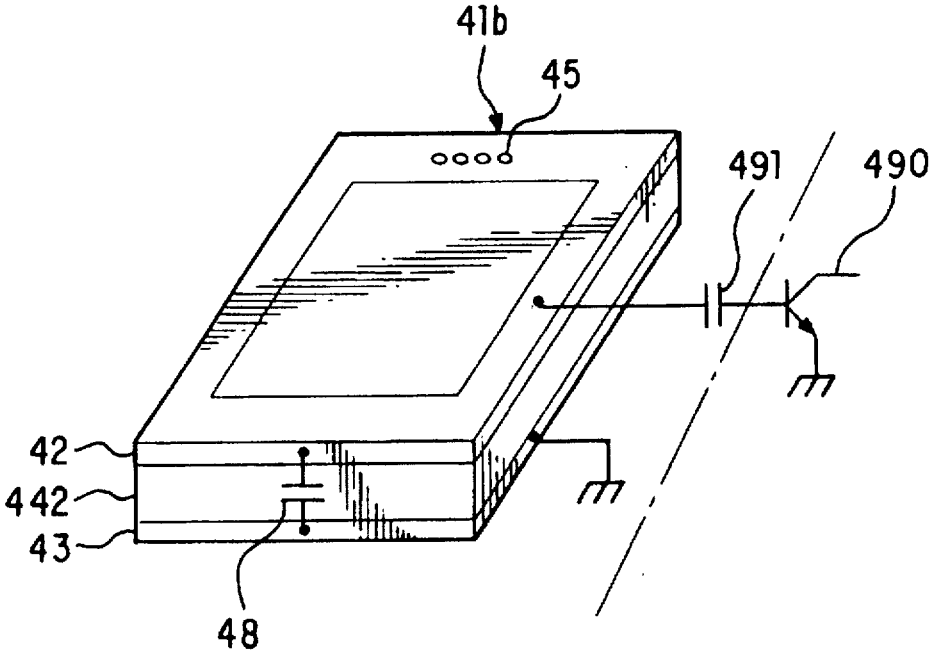
FIG. 30 is a block diagram of an antenna circuit and a wireless apparatus circuit of the antenna body illustrated in FIG. 29.

The coupling capacitor 491, as shown in FIG. 30, electrically connects the antenna body 41*b* and a transistor 490 that operates as an amplification circuit in the first stage of the wireless apparatus circuit. The connection position (feed point) of the coupling capacitor 491 and the antenna body 41*b* is located approximately in the center between the formation position of the short circuit 45 and the connection position of the tuning capacitance element 48, and performs impedance matching between the antenna body 41*b* and the wireless apparatus circuit to the slot 442.

Since the antenna body 41*b* formed in this way is formed in the area distant from the wireless apparatus circuit (transistor 490) on the circuit board 47, it is not influenced by noise generated by the wireless apparatus circuit.

Second Modification of Sixth Embodiment

Figure 31:
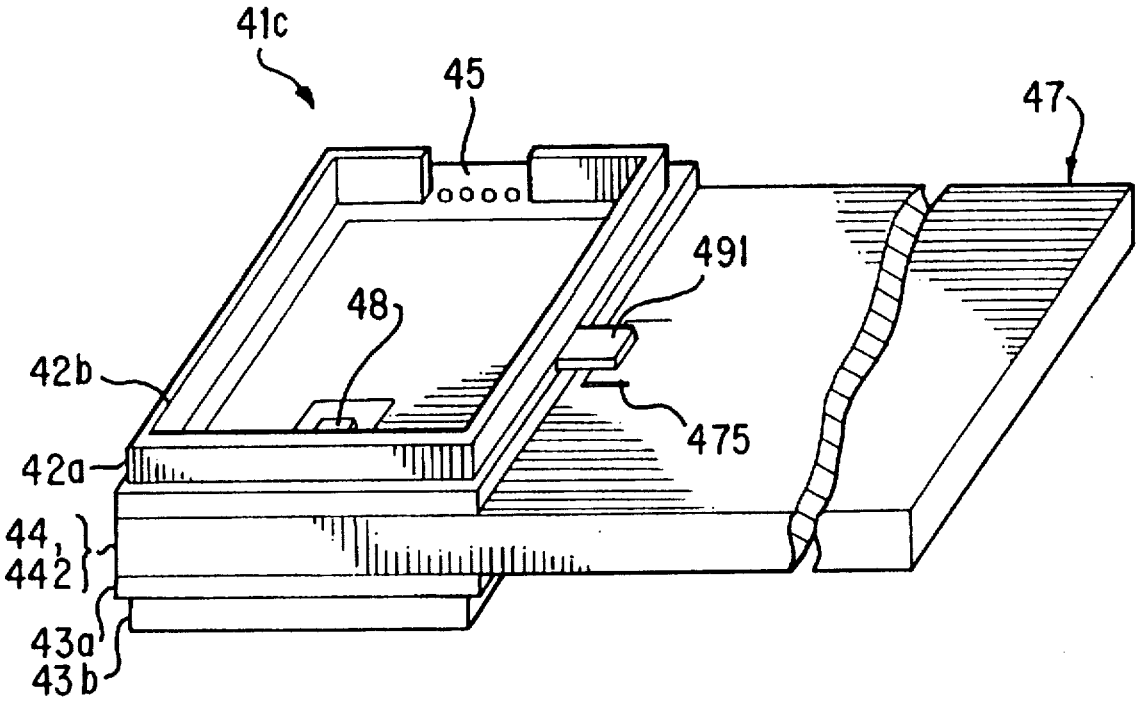
FIG. 31 illustrates the structure of an antenna body according to a second modification of the sixth embodiment.
Figure 32:
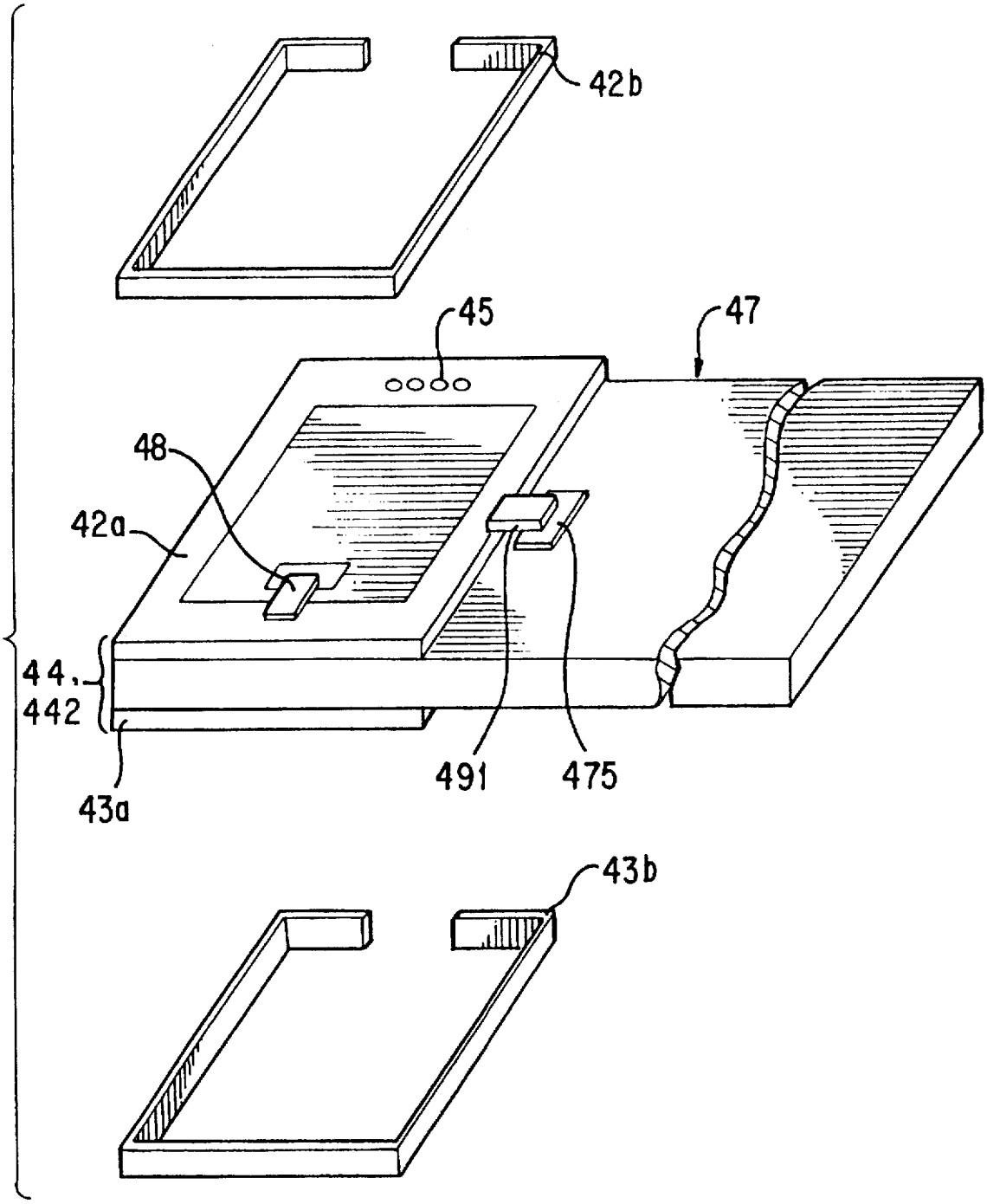
FIG. 32 is an exploded view of the antenna body illustrated in FIG. 31.

FIG. 31 illustrates the structure of an antenna body of a portable wireless apparatus (slot antenna device) according to a second modification of the sixth embodiment. FIG. 32 is an exploded view of an electrically conductive plate of the FIG. 31 antenna body.

In an antenna body 41*c* in this embodiment, as in the first modification of the sixth embodiment, the first conductor pattern 42*a* and the second conductor pattern 43*a* are formed by patterning a metal layer on both sides of a circuit board 47, and a gap 44 between them is a glass epoxy substrate of the circuit board 47 and is employed as a slot 442.

Furthermore, first and second rectangular electrically conductive plates 42*b* and 43*b* are soldered on the top of the first and second conductor patterns 42*a* and 43*a*. Accordingly, in the antenna body 41*c*, the first conductor pattern 42*a* and the first electrically conductive plate 42*b* are united to form one conductor, and the second conductor pattern 43*a* and the second electrically conductive plate 43*b* are united to form one conductor. Consequently, in this embodiment, compared with the antenna body according to the FIG. 29 embodiment, since the electrical conductivity of the first and second electrically conductive plates 42*b* and 43*b* contributes to the overall conductivity of each rectangular conductor, the resistance loss of the antenna body 41*c* is reduced and the sensitivity improves. In this embodiment, the first and second electrically conductive plates 42*b* and 43*b* have a cut-out part; but they can be complete loops.

Seventh Embodiment

Figure 33:
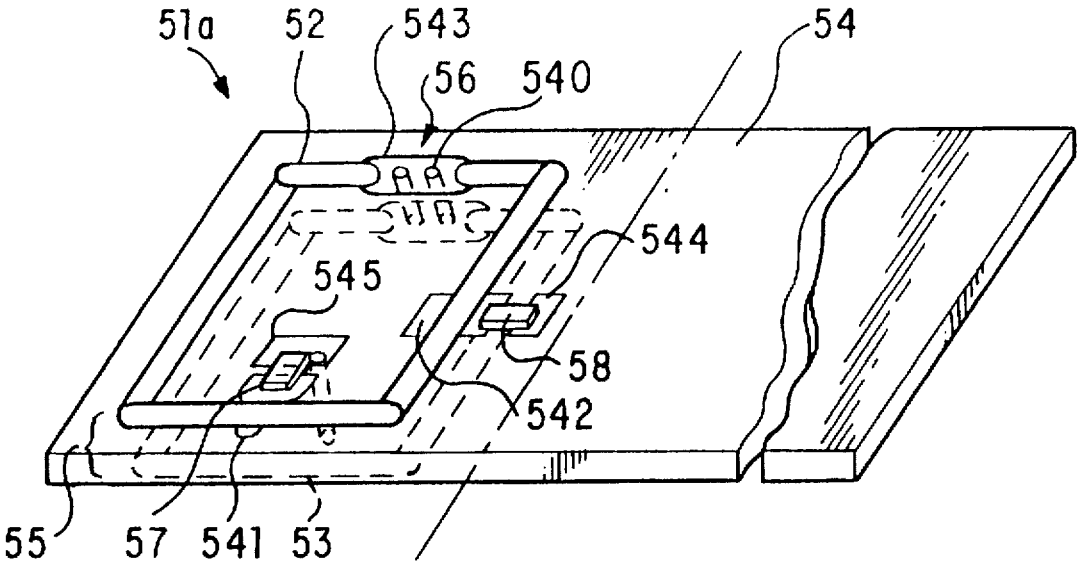
FIG. 33 illustrates the structure of an antenna body according to a seventh embodiment of the invention.

FIG. 33 illustrates the structure of an antenna body of a portable wireless apparatus (slot antenna device) according to a seventh embodiment of the present invention. In this embodiment, a slot antenna is composed of a circuit board and a conductor separate from the circuit board.

In the drawing, in an antenna body 51*a* in this embodiment, first and second metal wires 52 and 53 function as conductors and are soldered on conductor patterns 541, 542 and 543 formed on both sides of a circuit board 54 (two-sided circuit substrate). Accordingly, there is a gap 55 formed between the first and second metal wires 52 and 53.

In the conductor pattern 543, a short circuit 56 to electrically connect the first and second metal wires 52 and 53 is comprised of a conductive build-up formed inside a through-hole 540 of the circuit board.

Figure 34:
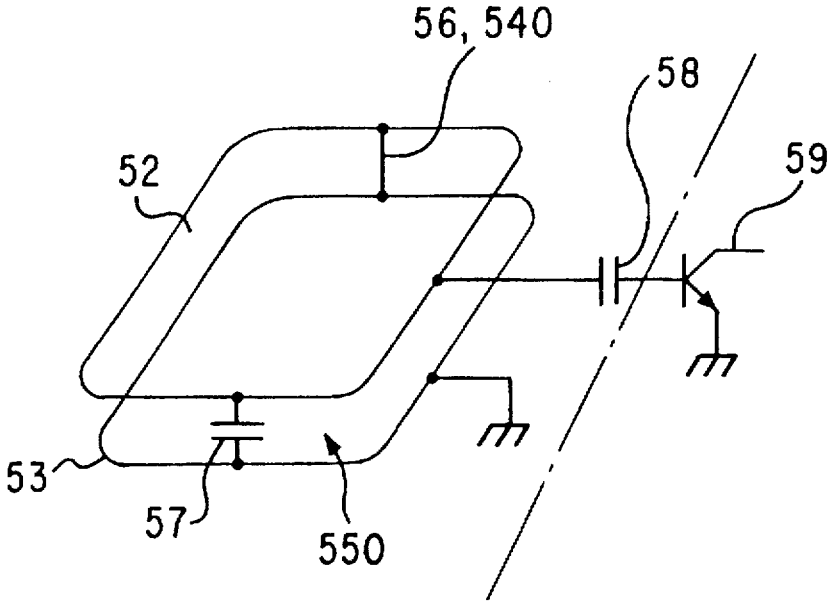
FIG. 34 is a block diagram of an antenna circuit and a wireless apparatus circuit of the antenna body illustrated in FIG. 33.

Consequently, as shown in FIG. 34, since a slot 550 is formed between the first and second metal wires 52 and 53 in a path extending from the short circuit 56 around the peripheries of the wires 52, 53 and ending at the short circuit 56, the antenna body 51*a* functions as a slot antenna.

A tuning capacitor 57 is mounted between the conductor pattern 541 and an adjacent conductor pattern 545. A coupling capacitor 58 is mounted between the conductor pattern 542 and an adjacent conductor pattern 544. The coupling capacitor 58, as shown in FIG. 34, is electrically connected with an amplification circuit 59 (e.g., a transistor) of a wireless apparatus circuit through the conductor pattern 544.

As is clear from the foregoing explanation, in this embodiment, since the antenna body 51*a* includes the conductor patterns 541 and 542 of the circuit board 54 and the through-hole 540, the antenna body 51*a* can be easily fixed and electrically connected.

Eighth Embodiment

Figure 35:
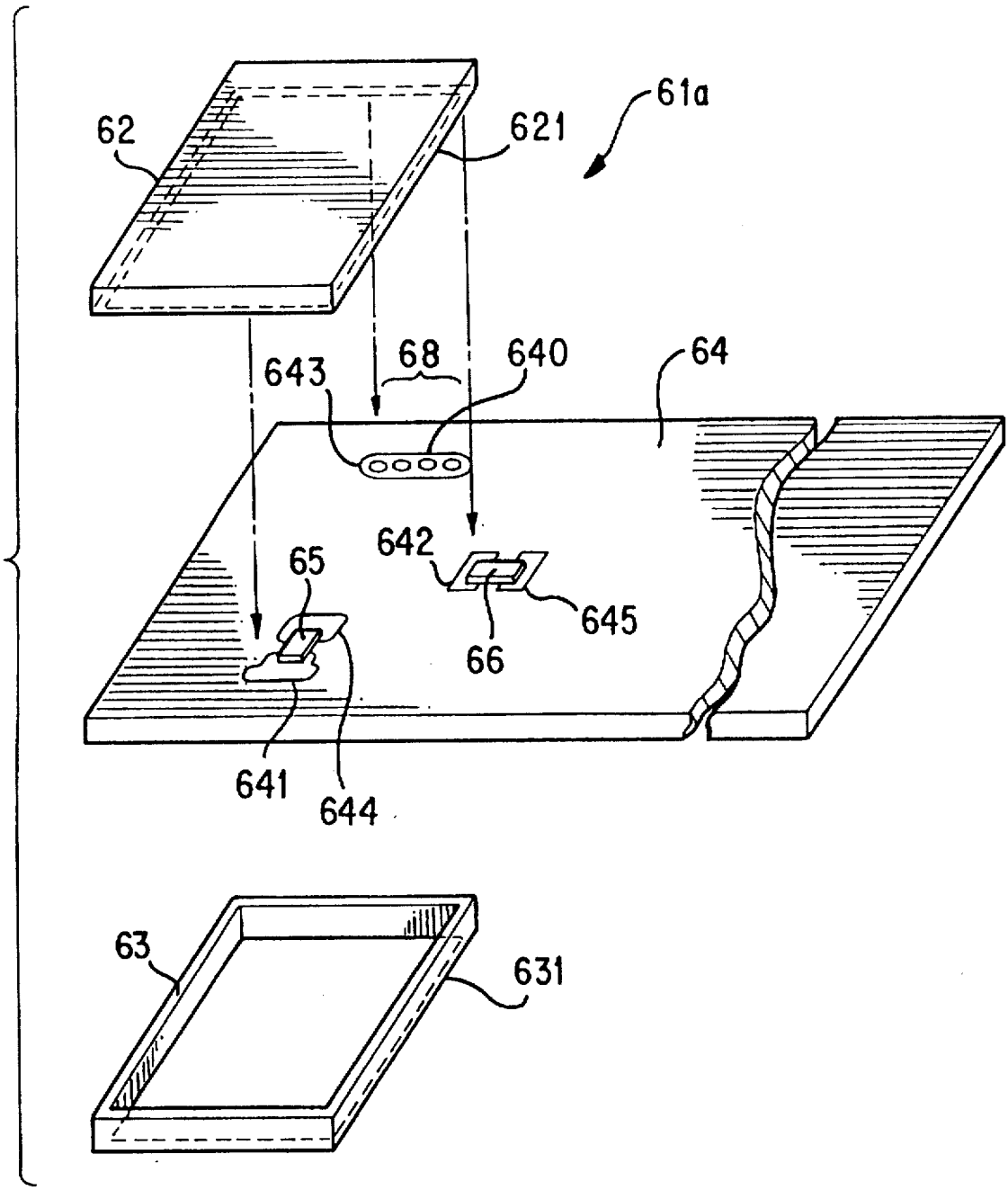
FIG. 35 illustrates the structure of an antenna body according to an eighth embodiment of the invention.

An antenna body 61*a* can be comprised of the first and second rectangular frame-shaped electrically conductive plates 62 and 63 shown in FIG. 35 instead of the first and second metal wires 52 and 53. In this case, first and second electrically conductive plates 62 and 63 are soldered on conductor patterns 641, 642 and 643 of a circuit board 64. A tuning capacitance element 65 and a coupling capacitor 66 are electrically connected with the first and second electrically conductive plates 62 and 63 making use of conductor patterns 644 and 645 formed adjacent to the conductor patterns 641 and 642. Furthermore, a short circuit 68 to electrically connect the first and second electrically conductive plates 62 and 63 is located in a through-hole 640 formed in the circuit board 64.

Side portions 621 and 631 are formed in the first and second electrically conductive plates 62 and 63, respectively, and the side portions 621 and 631 are soldered on the conductor patterns 641 and 642. Accordingly, since a gap is provided by the circuit board 64 between the first and second electrically conductive plates 62 and 63, a tuning capacitance element 65 and the conductor pattern 644 can be placed inside the inner periphery of plate 62.

First Modification of Eighth Embodiment

Figure 36:
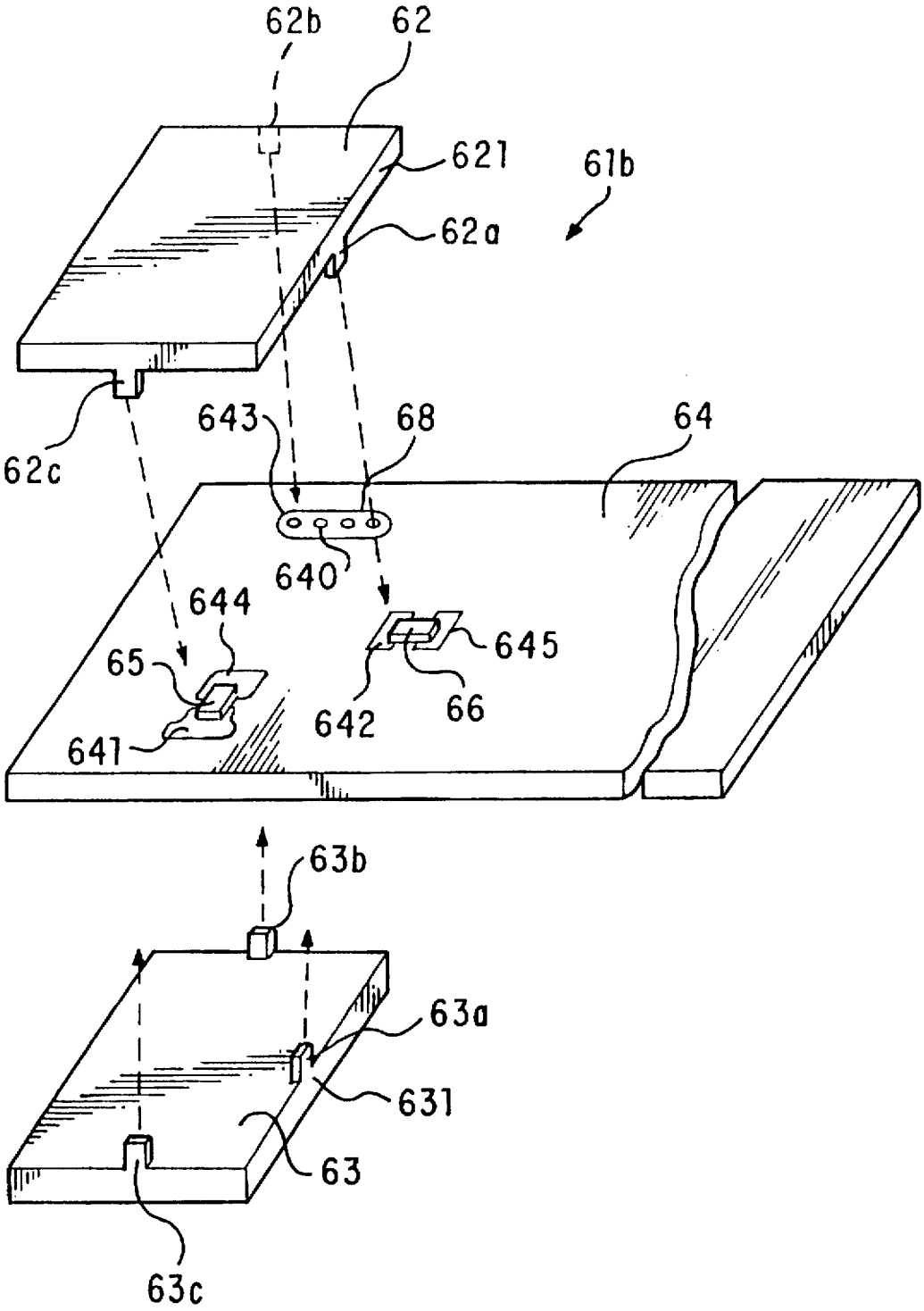
FIG. 36 illustrates the structure of an antenna body according to a first modification of the eighth embodiment.

FIG. 36 illustrates the structure of an antenna body of a portable wireless apparatus (slot antenna device) according to a first modification of the eighth embodiment.

In this embodiment, an antenna body 61*b* is composed of the first and second electrically conductive plates 62 and 63 having side portions 621 and 631, from which terminals 62*a* to 62*c* and 63*a* to 63*c* having the same length project. The terminals 62*a* to 62*c* and 63*a* to 63*c* are soldered on conductor patterns 641, 642 and 643, respectively, which are formed in a circuit board 64.

Accordingly, in the antenna body 61*b* in this embodiment, a gap (slot) having a width corresponding to the thickness of the circuit board 64 plus the length of the terminals 62*a* to 62*c* and 63*a* to 63*c* is formed. Consequently, the width of the slot can be changed by changing the length of the terminals 62*a* to 62*c* and 63*a* to 63*c*.

In this embodiment, a right half of the circuit board 64 is used to hold a wireless apparatus circuit. However, since the terminals 62*a* to 62*c* and 63*a* to 63*c* expand the gap between the first and second electrically conductive plates 62 and 63 and the circuit board 64, the wireless apparatus circuit can be formed inside the first and second electrically conductive plates 62 and 63 making use of this gap, without establishing the above-mentioned space to the right of the antenna body 61*b*.

Figure 37:
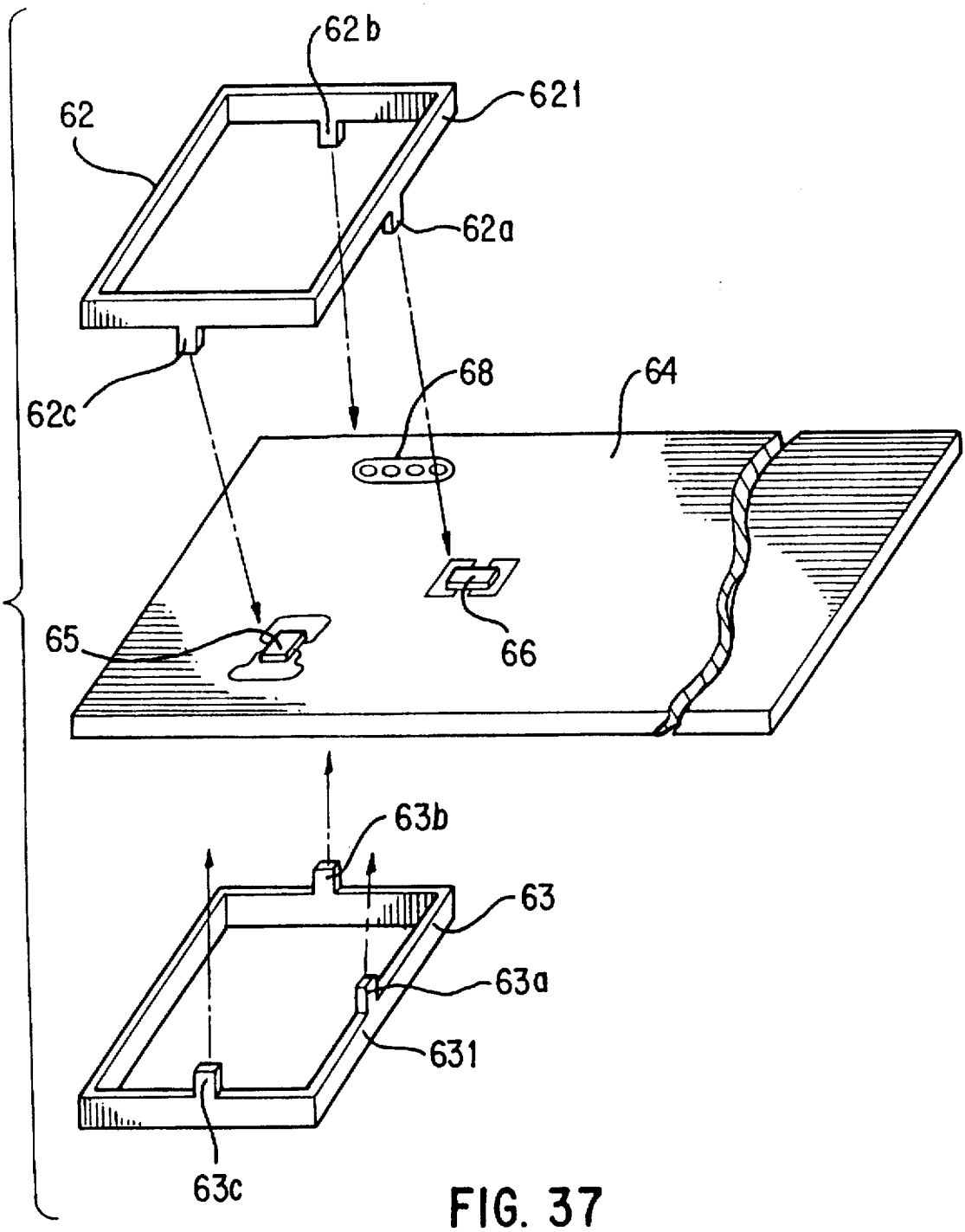
FIG. 37 illustrates the structure of an antenna body according to a second modification of the eighth embodiment.

As shown in FIG. 37, when the first and second electrically conductive plates 62 and 63 are composed only of parts corresponding to the side portions 621 and 631 and have a rectangular frame shape, it is possible to fix the first and second electrically conductive plates 62 and 63 on the circuit board 64 and the slot width can be adjusted by making use of the terminals 62*a* to 62*c* and 63*a* to 63*c*. In this case, the wireless apparatus circuit block also can be placed inside the first and second electrically conductive plates 62 and 63, and a liquid crystal display panel and so on can be formed on the top of the wireless apparatus circuit block to display information.

Figure 38:
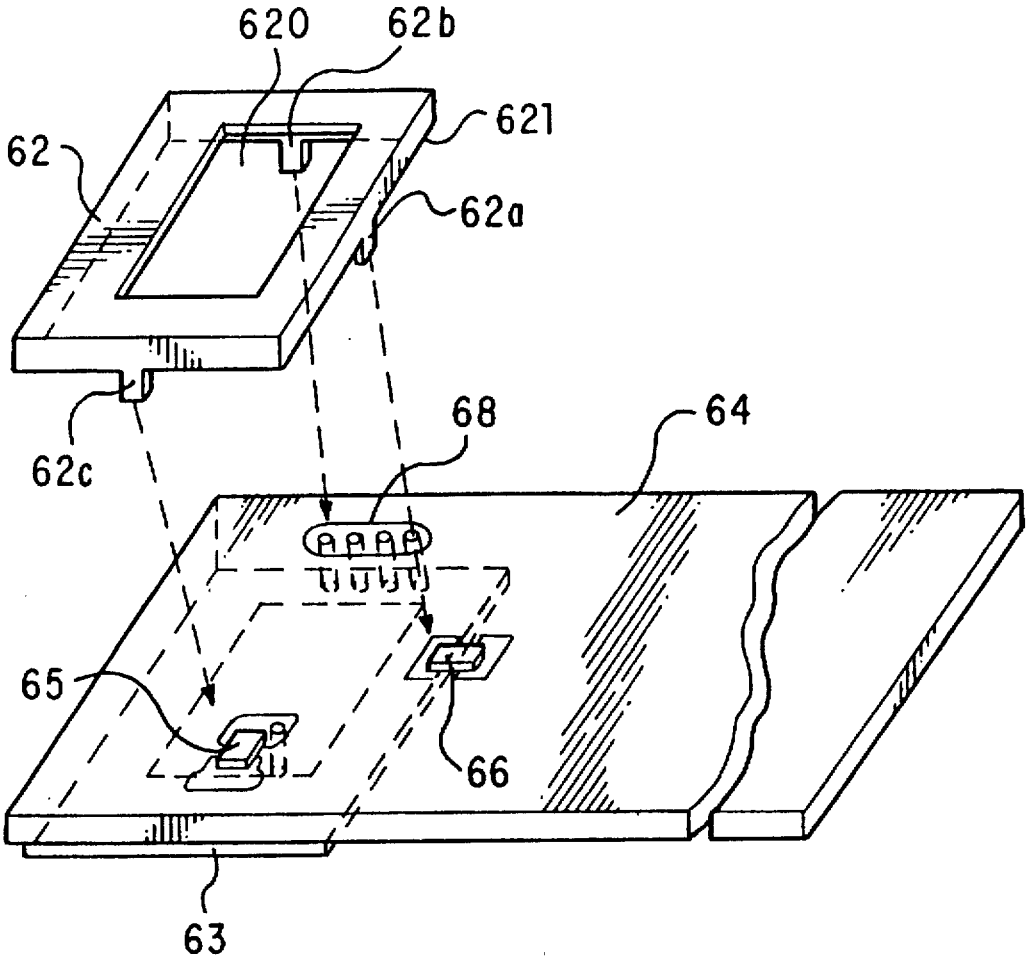
FIG. 38 illustrates the structure of an antenna body according to a third modification of the eighth embodiment.

Furthermore, as shown in FIG. 38, it is possible to form the side portion 621 and the terminals 62*a* to 62*c* only in the first electrically conductive plate 62 having an aperture 620 approximately in the center, and to form the second electrically conductive plate 63 as a planar plate without any terminals. In this case, the slot width also can be adjusted by the length of the terminals 62*a* to 62*c* on the side of the first electrically conductive plate 62.

Ninth Embodiment

Figure 39:
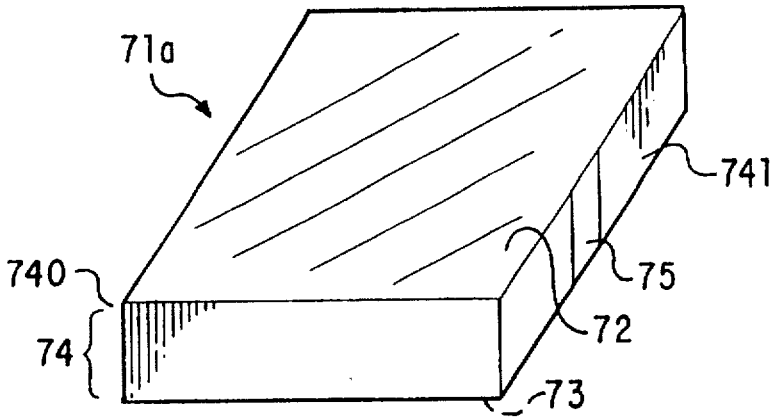
FIG. 39 illustrates the structure of an antenna body according to a ninth embodiment of the invention.

FIG. 39 illustrates the structure of an antenna body of a portable wireless apparatus (slot antenna device) according to a ninth embodiment of the invention.

A ceramic substrate 74 on both faces of which the first and second metal layers 72 and 73 are formed is employed in an antenna body 71*a* in this embodiment. A slot 740 is formed on the side 741 of ceramic substrate 74. A short circuit 75 to conductively connect the first and second metal layers 72 and 73 is formed in the lengthwise center of the side 741 of the ceramic substrate 74.

The antenna body 71*a* formed in this way can be easily miniaturized and thinned because the normal ceramic substrate 74 can be cut in a predetermined size and the short circuit 75 can be comprised of an electrically conductive coating layer, a build-up or a deposit on the side 741. Since the slot 740 between plates 72, 73 is filled with the ceramic substrate 74, the received wavelength can be apparently shortened. Accordingly, a small-sized antenna body can receive electromagnetic waves having relatively long wavelength.

First Modification of Ninth Embodiment

Figure 40:
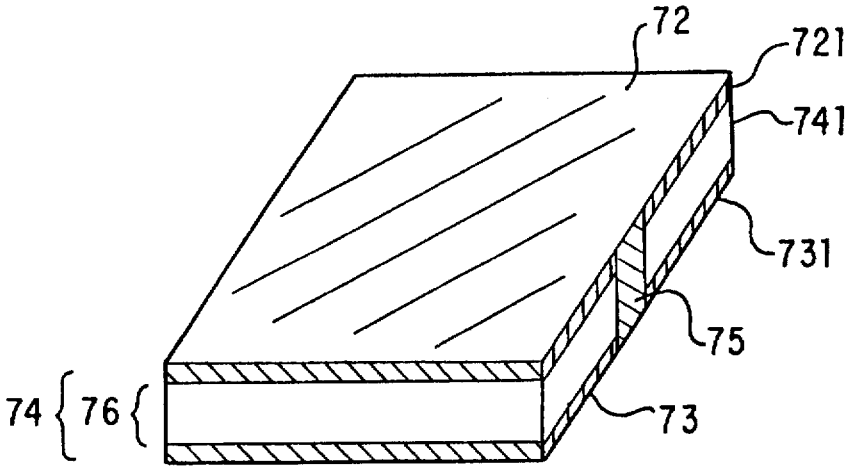
FIG. 40 illustrates the structure of an antenna body according to a first modification of the ninth embodiment.

In the antenna body 71*a* according to first modification of the ninth embodiment, as shown in FIG. 40, side portions 721 and 731 are formed using an electrically conductive coating layer, a build-up, or a deposit, etc., on the side portion 741 of the ceramic substrate 74 in such a way as to connect with the first and second metal layers 72 and 73. A gap between the side portions 721 and 731 defines a slot 76. In this case, the width of the slot 76 can be adjusted by adjusting the width of the side portions 721 and 731, and there is no need to change the thickness of the ceramic substrate 74.

Second Modification of Ninth Embodiment

Figure 41:
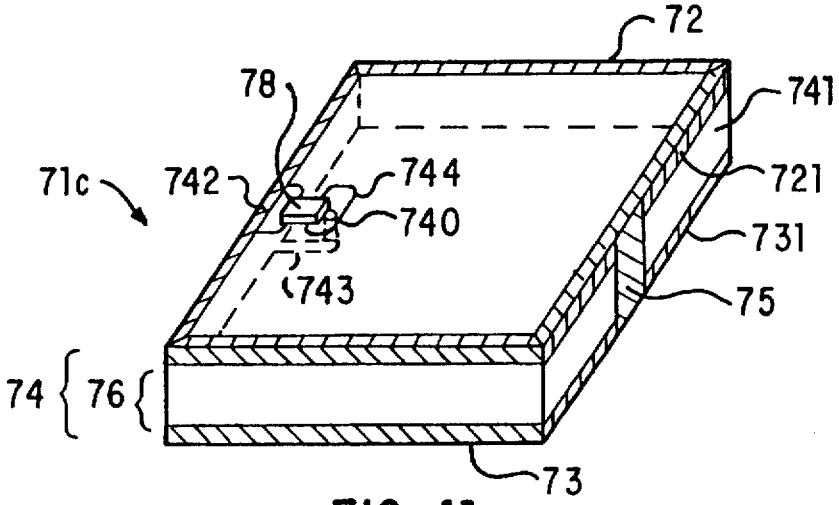
FIG. 41 illustrates the structure of an antenna body according to a second modification of the ninth embodiment.

Furthermore, in accordance with a second modification of the ninth embodiment, as shown in FIG. 41, both faces of the ceramic substrate 74 can be deposited with metal so that the first metal layer 72 and the second metal layer 73 are located only on an edge portion of the ceramic substrate 74, without leaving a metal layer in the center of substrate 74. In this case, a conductor pattern 742 to connect with the first metal layer 72 and a conductor pattern 744 adjacent to the conductor pattern 742 are formed on the surface of the ceramic substrate 74, and a conductor pattern 743 to connect with the second metal layer 73 is formed on the bottom of the ceramic substrate 74. The conductor pattern 743 is electrically connected with the conductor pattern 744 through a conductive material build-up in a through-hole 740. Additionally, a tuning capacitance element 78 can be electrically connected with the first and second metal layers 72 and 73 over a slot 76 by mounting the tuning capacitance element 78 to the conductor patterns 742 and 744.

Since an antenna body 71*c* formed in this way is a small-sized chip-like antenna body, it can be placed in a circuit board and so on as it is. Consequently, the antenna body 71*c* is appropriate for a miniaturized and thinned portable wireless apparatus.

Other embodiments

In addition to each structure shown in the above-mentioned embodiments and their modifications, it is possible to combine various features of them. For example, the circuit structures illustrated in FIGS. 2 and 3 can be combined with any of the embodiments or modifications thereof.

As explained above, in the present invention, a slot antenna device having a slot antenna body formed by an electrically conductive plate having a slot can include a circuit substrate inserted in the slot. Consequently, according to the present invention, the antenna body, being a slot antenna, is sensitive to magnetic components, and can be expected to have improved sensitivity when mounted on a human body. Accordingly, the antenna body is appropriate for use in a portable antenna device such as a pager. Since the circuit substrate is inserted in the slot, as when a dielectric material is filled in a slot, the wavelength of received signals can be apparently shortened. Accordingly, even a small-sized antenna body can receive electromagnetic waves having a relatively long wavelength.

If an electrically conductive plate is bent (flexed) at right angles to its plane direction, the slot can face in two to four directions, hence improving directivity characteristics of the antenna.

If an electrically conductive plate is opposed to (i.e., placed flat on) the surface of a circuit substrate in a slot antenna device having a slot antenna body defined by an electrically conductive plate having a slot, the antenna device can be thinned.

Furthermore, a reflector can be placed at the back of the electrically conductive plate. Consequently, the reflector can improve sensitivity of the miniaturized and thinned device.

According to the present invention, since an electrically conductive plate is comprised of a conductor pattern formed on the surface of a circuit substrate, the number of parts can be reduced thus further facilitating miniaturization.

In another aspect of the invention, a slot antenna body is formed making use of a pair of electrically conductive members opposed to each other across a gap which defines a slot at the outer periphery of the electrically conductive members. Consequently, a thin antenna body can be constituted and an antenna body with improved directivity can be formed because the slot opens toward the outer periphery.

If an aperture is formed corresponding to the formation area of a wireless apparatus circuit in the electrically conductive member, the display on a display panel formed on the top of the wireless apparatus circuit can be seen through the aperture of the electrically conductive member even if it is employed as a case main body.

Additionally, if the electrically conductive members are formed on the surface and at the back of a circuit substrate in which a wireless apparatus circuit is formed, respectively, the antenna body can be thinned and the thickness of the circuit substrate can be set so that the slot width is appropriate. In this case, the electrically conductive members can be comprised of a conductor pattern formed on the surface of the circuit substrate to decrease the number of parts.

While this invention has been described in conjunction with specific embodiments thereof, it is evident that many alternatives, modifications and variations will be apparent to those skilled in the art. Accordingly, the preferred embodiments of the invention as set forth herein are intended to be illustrative, not limitating. Various changes may be made without departing from the spirit and scope of the invention as defined in the following claims.

What is claimed is:

1. A slot antenna device comprising:

a pair of electrically conductive members opposed and parallel to each other in distinct planes, and spaced from each other by a predetermined gap, a connecting portion electrically connecting said pair of electrically conductive members at a predetermined position along outer peripheries of said pair of electrically conductive members, wherein said outer periphery of at least two adjacent edges of each of said pair of electrically conductive members is bent toward an other one of said pair of electrically conductive members to form bent portions defining a slot extending between said outer peripheries; and a wireless apparatus circuit coupled to said pair of electrically conductive members.

2. A slot antenna device according to claim 1, wherein said wireless apparatus circuit includes a circuit for transmitting signals.

3. A slot antenna device according to claim 1, wherein said wireless apparatus circuit includes a circuit for receiving signals.

4. A slot antenna device according to claim 1, wherein said electrically conductive members are metal plates.

5. A slot antenna device according to claim 1, further comprising a tuning capacitance element electrically connecting said pair of electrically conductive members approximately at a center of a length of said slot as measured from said connecting portion.

6. A slot antenna device according to claim 5, wherein said tuning capacitance element is a tuning varactor diode.

7. A slot antenna device according to claim 1, wherein said pair of electrically conductive members have, on opposed sides of said slot, a first feed point attached to terminals of said wireless apparatus circuit to define an unbalanced circuit, and a second feed point attached to a ground terminal of said wireless apparatus circuit.

8. A slot antenna device according to claim 1, wherein said pair of electrically conductive members have, on opposed sides of said slot, a feed point attached to two terminals of a balanced circuit of said wireless apparatus circuit.

9. A slot antenna device according to claim 5, wherein said wireless apparatus circuit is electrically connected to said pair of electrically conductive members at a pair of feed points that are located at a different position from the position of electrical connection of said tuning capacitance element to said pair of electrically conductive members.

10. A slot antenna device according to claim 9, wherein said pair of feed points are electrically connected to said pair of electrically conductive members substantially halfway between the position of said connecting portion electrically connecting said pair of electrically conductive members and the position of said tuning capacitance element electrically connecting said pair of electrically conductive members.

11. A slot antenna device according to claim 5, further comprising a case that contains said wireless apparatus circuit, wherein said connecting portion is located on a side of said case.

12. A slot antenna device comprising:

a pair of electrically conductive members opposed and parallel to each other in distinct planes, and spaced from each other by a predetermined gap, a connecting portion electrically connecting said pair of electrically conductive members at a predetermined position along outer peripheries of said pair of electrically conductive members, wherein said outer periphery of at least two adjacent edges of each of said pair of electrically conductive members extends toward an other one of said pair of electrically conductive members to form bent portions defining a slot extending between said outer peripheries; and a wireless apparatus circuit coupled to said pair of electrically conductive members, wherein a circuit block in which said wireless apparatus circuit is formed is located between said pair of electrically conductive members.

13. A slot antenna device according to claim 12, wherein both of said pair of electrically conductive members have an aperture in a portion located adjacent to and opposed to said circuit block.

14. A slot antenna device according to claim 13, wherein a display panel is located on a portion of said circuit block opposed to one of said apertures.

15. A slot antenna device according to claim 12, wherein:

a first one of said pair of electrically conductive members includes an aperture in a portion located adjacent to and opposed to said circuit block, said first electrically conductive member defining a case main body for defining an outer surface of said antenna device;

a second one of said pair of electrically conductive members defines a cover member for covering a back opening of said case main body, and further comprising an electrically insulative spacer located between said case main body and said cover member so that said slot is formed between said case main body and said cover member.

16. A slot antenna device comprising:

a circuit substrate having a first surface, a second surface facing in a direction opposite from said first surface, and containing a wireless apparatus circuit; and a first electrically conductive member located on said first surface of said circuit substrate, a second electrically conductive member located on said second surface of said circuit substrate, said first and second electrically conductive members opposed to each other and spaced from each other in distinct planes by a predetermined gap, a connecting portion electrically connecting said electrically conductive members at a predetermined position along outer peripheries of said electrically conductive members, said wireless apparatus circuit coupled to said first and second electrically conductive members wherein said outer periphery of at least two adjacent edges of each of said electrically conductive members is bent toward an other one of said electrically conductive members to form bent portions defining a slot extending between said outer peripheries.

17. A slot antenna device according to claim 16, wherein said wireless apparatus circuit includes a circuit for transmitting signals.

18. A slot antenna device according to claim 16, wherein said wireless apparatus circuit includes a circuit for receiving signals.

19. A slot antenna device according to claim 16, wherein said circuit substrate is a circuit board.

20. A slot antenna device according to claim 16, wherein said first and second electrically conductive members are metal plates.

21. A slot antenna device according to claim 16, wherein said first and second electrically conductive members have, on opposed sides of said slot, a first feed point attached to terminals of said wireless apparatus circuit to define an unbalanced circuit, and a second feed point attached to a ground terminal of said wireless apparatus circuit.

22. A slot antenna device according to claim 16, wherein said first and second electrically conductive members have, on opposed sides of said slot, a feed point attached to two terminals of a balanced circuit of said wireless apparatus circuit.

23. A slot antenna device according to claim 16, further comprising a tuning capacitance element electrically connected to said first and second electrically conductive members approximately at a center of a length of said slot as measured from said connecting portion.

24. A slot antenna device according to claim 23, wherein said tuning capacitance element is a tuning varactor diode.

25. A slot antenna device according to claim 23, wherein said tuning capacitance element is electrically connected with both of said first and second electrically conductive members through a through-hole located in said circuit substrate.

26. A slot antenna device according to claim 23, wherein at least one said first and second electrically conductive members is a conductor pattern formed on said circuit substrate.

27. A slot antenna device according to claim 23, wherein at least one of said first and second electrically conductive members is attached to a conductor pattern formed on said circuit substrate at a location corresponding to a predetermined position of said at least one electrically conductive member.

28. A slot antenna device according to claim 27, wherein said first and second electrically conductive members are electrically conductive wires.

29. A slot antenna device according to claim 27, wherein said first and second electrically conductive members include terminals that project toward said circuit substrate and are attached to said conductor pattern on said circuit substrate.

30. A slot antenna device according to claim 16, wherein said first and second electrically conductive members are located on a first area of said circuit substrate and said wireless apparatus circuit is located on a second area of said circuit substrate adjacent to said first area.

31. A slot antenna device according to claim 16, wherein said connecting portion is located in a through-hole of said circuit substrate.

32. A slot antenna device according to claim 16, wherein said first and second electrically conductive members are placed along an edge portion of said circuit substrate.

33. A wireless apparatus comprising:

a slot antenna circuit;

a connection circuit coupled to said slot antenna circuit;

an amplification circuit coupled to said connection circuit;

a demodulating circuit coupled to said amplification circuit;

said slot antenna circuit including a pair of electrically conductive members opposed and parallel to each other in distinct planes, and spaced from each other by a predetermined gap, a connecting portion electrically connecting said pair of electrically conductive members at a predetermined position along outer peripheries of said pair of electrically conductive members; said connection circuit being coupled to said pair of electrically conductive members wherein said outer periphery of at least two adjacent edges of each of said pair of electrically conductive members is bent toward an other one of said pair of electrically conductive members to form bent portions defining a slot extending between said outer peripheries.

34. A wireless apparatus comprising:

a slot antenna circuit;

a connection circuit coupled to said slot antenna circuit;

an amplification circuit coupled to said connection circuit;

a demodulating circuit coupled to said amplification circuit;

said slot antenna circuit including a circuit substrate having a first surface, a second surface facing in a direction opposite from said first surface, and containing said connection circuit, said amplification circuit, and said demodulating circuit; and a first electrically conductive member located on said first surface of said circuit substrate, a second electrically conductive member located on said second surface of said circuit substrate, said first and second electrically conductive members opposed to each other and spaced from each other in distinct planes by a predetermined gap, a connecting portion electrically connecting said electrically conductive members at a predetermined position along outer peripheries of said electrically conductive members; said connection circuit coupled to said first and second electrically conductive members wherein said outer periphery of at least two adjacent edges of each of said of electrically conductive members is bent toward an other one of said electrically conductive members to form bent portions defining a slot extending between said outer peripheries.

35. A slot antenna device comprising:

a pair of electrically conductive members in distinct planes separated by a gap, wherein each electrically conductive member is formed as a closed figure; and a conductor electrically connecting said pair of electrically conductive members and forming an electrical short across said gap, wherein said conductive members and said conductor form a continuous conductive antenna structure wherein an outer periphery of at least two adjacent edges of each of said pair of electrically conductive members is bent toward an other one of said pair of electrically conductive members to form bent portions defining a slot extending between said outer periphery of each of said pair of electrically conductive members.

* * * * *